US008038258B2

(12) United States Patent
Ray et al.

(10) Patent No.: US 8,038,258 B2
(45) Date of Patent: Oct. 18, 2011

(54) PRINT HEAD SERVICE SHUTTLE

(75) Inventors: Paul C. Ray, San Diego, CA (US); Jennifer Marie McCord Brister, San Marcos, CA (US); Jack A. Overway, San Diego, CA (US); William R James, Vista, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 481 days.

(21) Appl. No.: 12/251,977

(22) Filed: Oct. 15, 2008

(65) Prior Publication Data

US 2009/0122107 A1 May 14, 2009

(51) Int. Cl.
*B41J 23/00* (2006.01)

(52) U.S. Cl. ..... 347/37

(58) Field of Classification Search ..... None
See application file for complete search history.

(56) References Cited

U.S. PATENT DOCUMENTS

| | | | | |
|---|---|---|---|---|
| 4,340,897 | A | 7/1982 | Miller | |
| 5,270,738 | A | 12/1993 | Takahashi et al. | |
| 5,280,308 | A | 1/1994 | Takahashi et al. | |
| 6,565,183 | B2 | 5/2003 | Goto et al. | |
| 6,578,945 | B2 | 6/2003 | Hashi et al. | |
| 6,837,636 | B2 | 1/2005 | Sawyer et al. | |
| 7,229,149 | B2 | 6/2007 | Wotton et al. | |
| 7,240,985 | B2 * | 7/2007 | Rogers, IV | 347/37 |
| 2002/0005872 | A1 | 1/2002 | Goto et al. | |
| 2002/0075349 | A1 | 6/2002 | Sawicki | |
| 2002/0167563 | A1 | 11/2002 | Sawyer et al. | |
| 2003/0081053 | A1 | 5/2003 | Barinaga et al. | |
| 2005/0024421 | A1 | 2/2005 | Barinaga et al. | |
| 2005/0035990 | A1 | 2/2005 | Wotton et al. | |
| 2006/0284906 | A1 * | 12/2006 | Jeong et al. | 347/5 |
| 2007/0171251 | A1 | 7/2007 | Sekimoto et al. | |

* cited by examiner

*Primary Examiner* — Stephen Meier
*Assistant Examiner* — Alexander C Witkowski

(57) ABSTRACT

A printer includes a first print head support carrying a plurality of print heads. The first print head support is movable towards and away from the media support and includes one or more guides movably supporting a first print head service shuttle along the media support.

22 Claims, 16 Drawing Sheets

PRINT HEAD SERVICE SHUTTLE

This application claims the benefit of U.S. provisional patent application Ser. No. 60/987,020, filed on Nov. 9, 2007, entitled "PRINT HEAD SERVICE SHUTTLE". The present application is related to co-pending U.S. patent application Ser. No. 12/251,985 filed on the same day herewith by Paul Ray and entitled "MOVABLE FLUID RECEIVER", the full disclosure of which is hereby incorporated by reference. The present application is related to co-pending U.S. patent application Ser. No. 12/251,968 filed on the same day herewith by Paul Ray, Neil Doherty, Mun Yew Lee and Thomas J. Tarnacki and entitled "WEB FLOW PATH", the full disclosure of which is hereby incorporated by reference. The present application is related to co-pending U.S. patent application Ser. No. 11/402,425 filed on Apr. 12, 2006 by Kevin T. Kersey and Timothy J. Carlin and entitled "WEB", the full disclosure of which is hereby incorporated by reference.

BACKGROUND

Servicing of print heads in a printer is sometimes performed to maintain performance of the print heads. Existing methods and devices for servicing the print heads may increase the footprint of the printer and may result in misalignment of the print heads with the media being printed upon.

DETAILED DESCRIPTION OF THE EXAMPLE EMBODIMENTS

Figure 1:
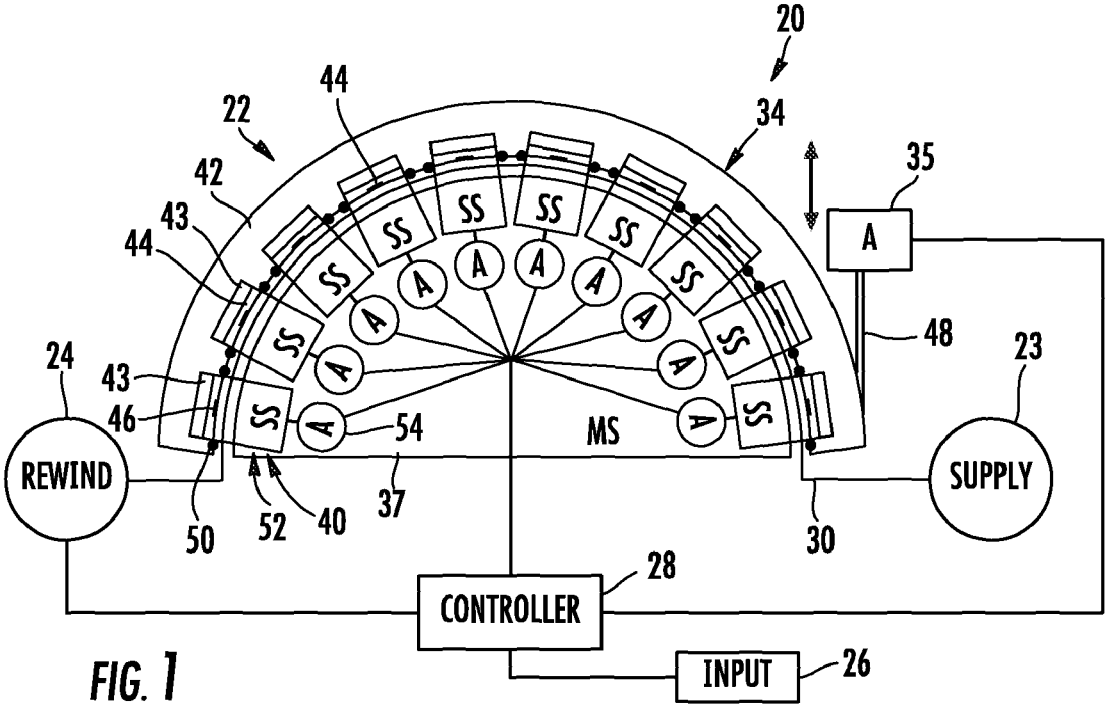
FIG. 1 is a schematic illustration of a printing system according to an example embodiment.

FIG. 1 schematically illustrates printing system 20 according to an example embodiment. Printing system 20 is configured to print or otherwise deposit printing material, such as ink or other fluid material, onto a web 30 of media. As will be described hereafter, printing system 20 facilitates the servicing of its print heads with a reduced footprint and with a reduced risk of misalignment of the print heads with the media being printed upon.

Printing system 20 includes a print unit or print module 22, media supply 23 and media collector or media rewind 24. Print module 22 selectively deposits printing material upon web 30 to form an image, pattern, layout or arrangement of printing material upon web 30. In one embodiment, web 30 may comprise a web of printing material such as a cellulose-based media. In another embodiment, web 30 may comprise a web of polymeric material. In yet another embodiment, web 30 may comprise one or more other materials. In one embodiment, the printing material comprises a fluid such as one or more inks. In yet other embodiments, the printing material may comprise other types of fluid.

Print module 22 receives the web 30 of media from web supply 23, prints upon web 30 and discharges the printed upon web 30 to media rewind 24 which rewinds the web 30 of media. Although web 30 is illustrated as continuously extending from supply 23, across print module 22, to rewind 24, in other embodiments, media rewind 24 may be omitted where the printed upon web 30 of media is severed or processed in other fashions.

Print module 22 includes printer 34, actuator 35, media support 37 and print head servicing system 40. Printer 34 comprises a device or mechanism configured to selectively deposit printing material. Printer 34 includes main support 42, print head supports 43 and one or more pens or cartridges 44. Main support 42 comprises a frame or structure configured to support and unite individual print head supports 43 and their cartridges 44 opposite to web 30. In the particular example illustrated, main support 42 is configured to support print head supports 43 and cartridges 44 along an arc opposite to web 30. In one embodiment, support 42 is movable towards and away from web 30. In yet another embodiment, support 42 is stationary opposite to web 30.

Print head supports 43 comprise structures axially extending across the arc provided by main support 42, parallel to the centerline of the semi-cylindrical arc. Print head supports 43, sometimes referred to as print bars, extend across a width of media support 37 and support the one or more print cartridges 44. Supports 43 facilitate removal of cartridges 44 from main support 42 for repair or replacement of individual print cartridges 44 without removal of all of the print cartridges 44 from main support 42. In other embodiments where print cartridges 44 are directly supported by support 42, supports 43 may be omitted.

Cartridges 44 (also known as pens) comprise mechanisms configured to eject fluid onto web 30. In the particular example illustrated, cartridges 44 each include one or more print heads 46 (schematically shown on cartridges 44). In one embodiment, print heads 46 each comprise thermal resistive drop-on-demand inkjet print heads. In yet other embodiments, print heads 46 may comprise piezo resistive inkjet print heads. In still other embodiments, print heads 46 may comprise other mechanisms configured to eject fluid in a controlled manner.

According to one embodiment, cartridges 44 each include a self-contained reservoir of fluid which is applied to the associated print heads 46. In yet another embodiment, cartridges 44 each include a reservoir which is further supplied with fluid or ink via an offer-axis ink supply system using one or more pumps or other mechanisms to supply a fluid to each of cartridges 44. In one embodiment, cartridges 44 of printer 34 are configured to apply multiple colors of ink. In the embodiment illustrated, cartridges 44 configured to deposit black (K), cyan (C), magenta (M) and yellow (Y) colored inks. In the example illustrated, printer 34 is additionally configured to apply a fixer (F) to web 30 prior to application of the colored inks. In other embodiments, printer 34 may include a fewer or greater of such cartridges configured to apply a fewer or greater of such different types of fluid.

Actuator 35 comprise a mechanism configured to selectively raise and lower support 42 to raise and lower cartridges 44 relative to web flow path 36 and web 30. As a result, support 42 may be moved to facilitate enhanced access to cartridges 44 for inspection, repair or replacement. In some embodiment, movement of support 42 and cartridges 44 may further facilitate servicing of print heads 46.

In one embodiment, actuator 35 comprises one or more hydraulic or pneumatic cylinder assemblies. In another embodiment, actuator 35 comprises one or more electric solenoids. In yet another embodiment, actuator 35 may comprise one or more cams driven by one or more motors. In other embodiments, ball screw mechanisms are used. In such embodiments, movement of support 42 by actuator 35 may be guided by one or more guide rods, tracks or other guide structures 48. In still other embodiments, the one or more guides 48 may be omitted.

Media support 37 comprises one or more structures configured to support and guide movement of web 30 across an opposite to print heads 46 of cartridges 44. In the particular embodiment illustrated, media support 37 supports web 30 in an arc opposite to print heads 46. As a result, print module 22 may be more compact and enhanced control over print head to media spacing is achieved. According the one embodiment, media support 37 comprises a series of arcuately arranged rollers. In another embodiment, media support 37 may comprise an arcuate plate or platen. In other embodiments, media support 37 may have other configurations.

Print head servicing system 40 comprises an arrangement of devices or components configured to facilitate and perform one or more servicing operations upon print heads 46. Examples of servicing operations include, but are not limited to, wiping, spitting and capping. As will be described hereafter, print head servicing system 40 facilitates such servicing operations with reduced or no movement or print heads 46. As a result, the risk of print heads 46 becoming misaligned with web 30 is reduced. Printed services system 40 further provides that servicing operations while not largely increasing a footprint of module 22.

Print head servicing system 40 includes guides 50 and print head service shuttles 52. Guides 50 comprise one or more structures configured to died, support and direct movement of service shuttles 52 across media support 37 to positions opposite to print heads 46 for servicing of print heads 46. Guides 50 are each dedicated to an associated with particular print head supports 43 and their associated cartridges 44. In the example illustrated, guides 50 are coupled to and provided as part of print head supports 43. As a result, print head supports 43 and the associated guides 50 may be assembled an inventory as individual units. In addition, such individual units may be more easily separated and removed from main support 42 for repair or replacement. According to one example embodiment, guides 50 comprise C-shaped tracks or channels in and along which rollers or other low friction bearing structures associated with service shuttles 52 rotate, slide or otherwise translate. In other embodiments, guides 50 may comprise other structures for guiding movement of service shuttles 52 across media support 37 to positions opposite to print heads 46. Although guides 50 are illustrated as being provided on opposite sides of each of print head supports 43, in other embodiments, guides 50 may alternatively extend along a single side of each of print head supports 43 or at a single intermediate location between opposite sides of print head support 43.

Figure 3:
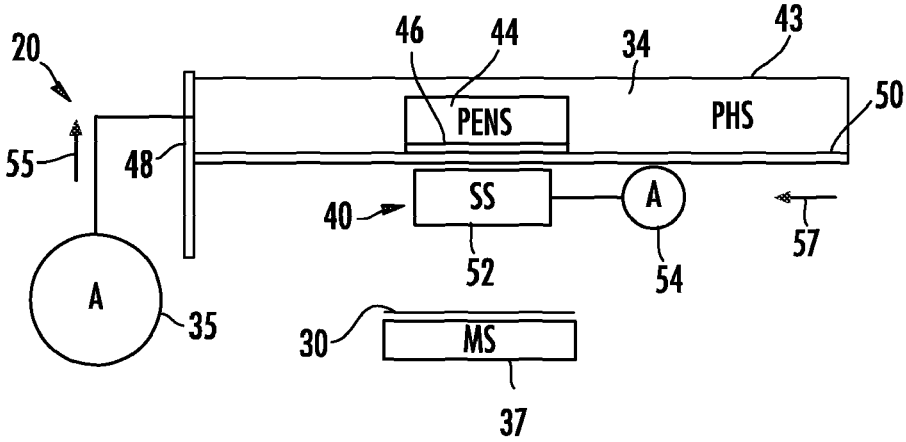
FIG. 3 is a schematic illustration of the printing system of FIG. 1 in a print head servicing position according to an example embodiment.

Service shuttles 52 comprise devices configured to move along guides 50 between a servicing positioned and a withdrawn position for printing. Servicing shuttles 52 are configured to perform one or more servicing operations, such as wiping, spitting and capping, upon print heads 46. As schematically shown in FIGS. 1 and 3, each service shuttle 52 is associated with an actuator 54 configured to serve as a shuttle drive for moving the associated shuttle 52 between the servicing position and the withdrawn position. In particular, each actuator 54 is configured to linearly translate its associated service shuttle 52 along the one or more guides 50.

In one embodiment, each actuator 54 may be supported and carried by its associated service shuttle 52. In another embodiment, portions of the actuator 54 may be stationary and operably coupled to service shuttles 52. According to one embodiment, actuator 54 comprises a rack gear extending along each of guides 50 and a pinion gear carried by service shuttle 52 in engagement with the rack gear, wherein rotation of the pinion gear, such as by a motor carried by service shuttle 52, moves the individual service shuttle 52 along the rack gear and along the associated guide 50. In another embodiment, actuator 54 may have other configurations.

Input 26 comprises one or more mechanism by which instructions are commands may be provided to controller 28. Example of input 26, include, but are not limited to, a keyboard, a keypad, a touchpad, a touch screen, a microphone with speech recognition software, one or more buttons, switches and the like. Although input 26 is illustrated as being associated with print model 22, input 26 may alternatively be associated with dryer module 24 or may be an external source of commands which transmits control signals via the internet, a network or other wired or wireless communication medium.

Controller 28 comprises one or more processing units and associated memories configured to generate control signals directing the operation of print module 22. In particular, in response to or based upon commands received via input 26 or instructions contained in the memory of controller 28, controller 28 generates control signals directing operation of actuator 35 to selectively raise and lower support 42 and cartridges 44, control signals directing the application or deposition of printing material by cartridges 44 and print heads 46, control signals directing supply 23 and/or rewind 24 to control the tension of web 30 end the rate at which web 30 is moved across media support 37, and control signals directing actuators 54 to move service shuttles 52 along guides 50 between the servicing position and the withdrawn position.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 28 may be embodied as part of one or more application-specific integrated circuits (ASICs). Unless otherwise specifically noted, the controller is not limited to any specific combination of hardware circuitry and software, nor to any particular source for the instructions executed by the processing unit.

Figure 2:
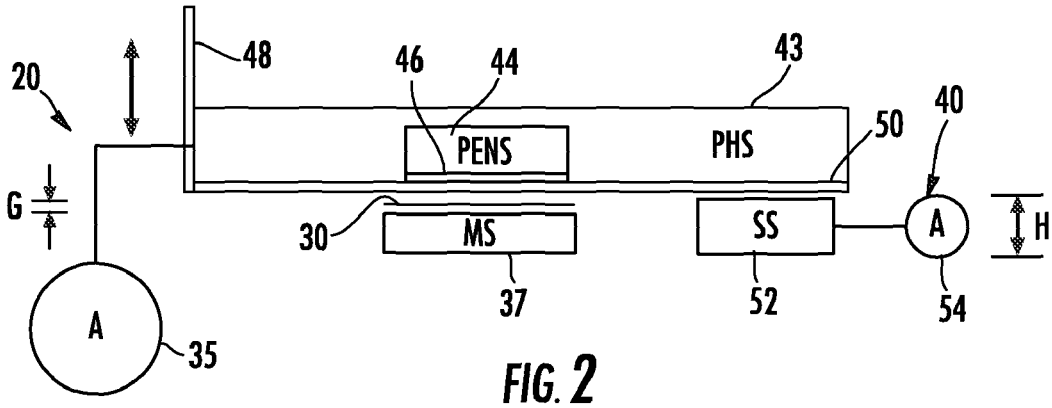
FIG. 2 is a schematic illustration of the printing system of FIG. 1 in a printing position according to an example embodiment.

FIGS. 2 and 3 illustrate operation of printing system 20. FIG. 2 illustrates a printing system 20 in a printing mode. As shown by FIG. 2, controller 28 (shown in FIG. 1) generates control signals directing actuator 35 to lower main support 42 (shown in FIG. 1) which lowers individual print head supports 43 and their associated pens or cartridges 44 to a lowered printing position in which print heads 46 are closely spaced to web 30 supported by media support 37. In the particular example illustrated, print heads 46 are space from web 30 by a gap G. In one embodiment, a gap G is less than or equal to about 3 mm. In other embodiments, this gap may have other dimensions. Controller 28 further generates control signals directing cartridges 44 and print heads 46*th* to deposit a printing material upon web 30.

At the same time, service shuttles 52 is moved by actuator 54 to a withdrawn position as shown in which service shuttles 52 is withdrawn from or not opposite to either web 30 or print heads 46. In one embodiment, each service shuttle 52 has a height H greater than the distance of gap G, enabling printing without interference from service shuttles 52.

FIG. 3 illustrates printing system 20 in a print head servicing mode. In response to commands received via input 26 or based upon stored instructions or stored parameters, controller 28 generates control signals initiating servicing. In one embodiment, controller 28 may of instructions stored in memory that automatically initiate the servicing mode upon the lapse of a predetermined amount of time, at predetermined times, or based upon usage of printing system 20, such as the amount of printing material used or the amount of web 30 that has been printed upon, exceeding an input or stored threshold.

As shown in FIG. 3, controller 28 initiates servicing by generating control signals directing actuator 35 to lift or raise one or more a print head supports 34 in the direction indicated by arrow 55 from the lowered printing position shown in FIG. 2 to the raised position shown in FIG. 3. In the raised position, print heads 46 are spaced from web 30 by a distance greater than the height of service shuttle 52. In one embodiment, actuator 35 raises main support 42 which causes all of the associated print heads 43 and their associated print heads 46 to be moved to the raised position in unison. In other embodiments, a separate actuator may be associated with each print head support 43 to individually and independently raise print heads 43 for individual and independent servicing by service shuttles 52. In such an embodiment, some of print heads 46 are serviced while others continue to print upon web 30.

Once print head support 34 has been moved to the raised position shown in FIG. 3, controller 28 generates control signals directing actuator 54 to move service shuttle 52 in the direction indicated by arrow 57 to the servicing position shown in FIG. 3 in which service shuttle 52 extends opposite to be print head 46 to be serviced, sandwiched between the print is 46 to be serviced and web 30. Once positioned across from print head 46, service shuttle 52 performs the one or more servicing operations upon the print heads.

Upon completion of the servicing operations, controller 28 generates control signals directing actuator 54 to retract service shuttle 52 to the withdrawn position shown in FIG. 2. Thereafter, controller 28 generates control signals directing actuator 35 to once again lower print head support 43 and cartridge 44 to the printing position shown in FIG. 2, in which cartridges 44 are ready for printing.

Because printing system 20 raises and lowers one or more of print head supports 43 between the lowered printing position shown in FIG. 2 and the raised servicing position shown in FIG. 3, service shuttle 52 may be provided with a height H greater than the printing gap G. Because service shuttle 52 is moved between the withdrawn position shown in FIG. 2 and the servicing position shown in FIG. 3, servicing of print heads 46 may performed without sideways or lateral movement of print heads 46 and without repositioning of web 30. As a result, printing misalignment issues are reduced and printing system 20 is more compact.

Figure 4:
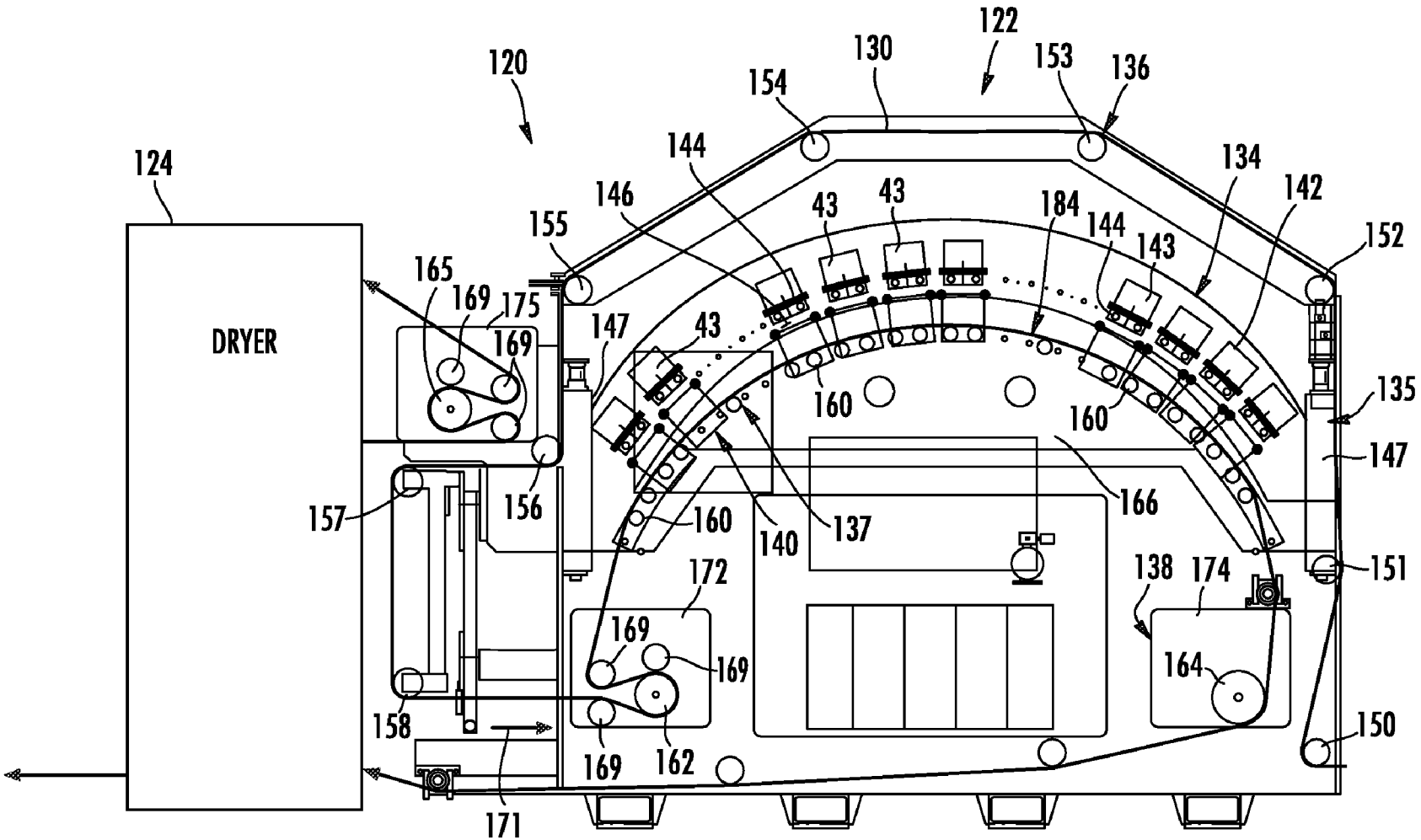
FIG. 4 is a side elevational view of a printer and dryer system, with portions schematically shown, according to an example embodiment.
Figure 5:
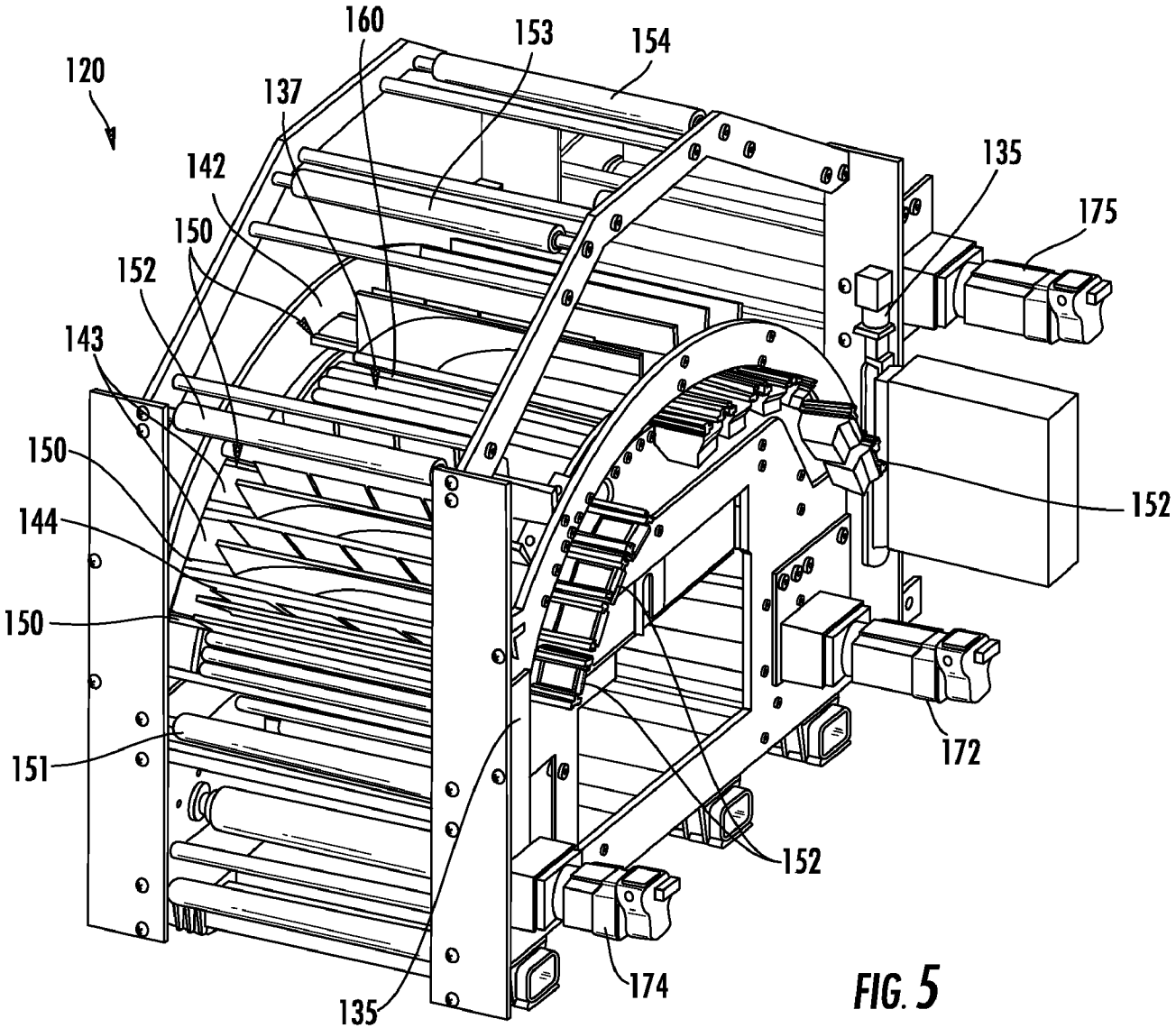
FIG. 5 is a top perspective view of the printer and dryer system of FIG. 4 and a printing position according to an example embodiment.
Figure 6:
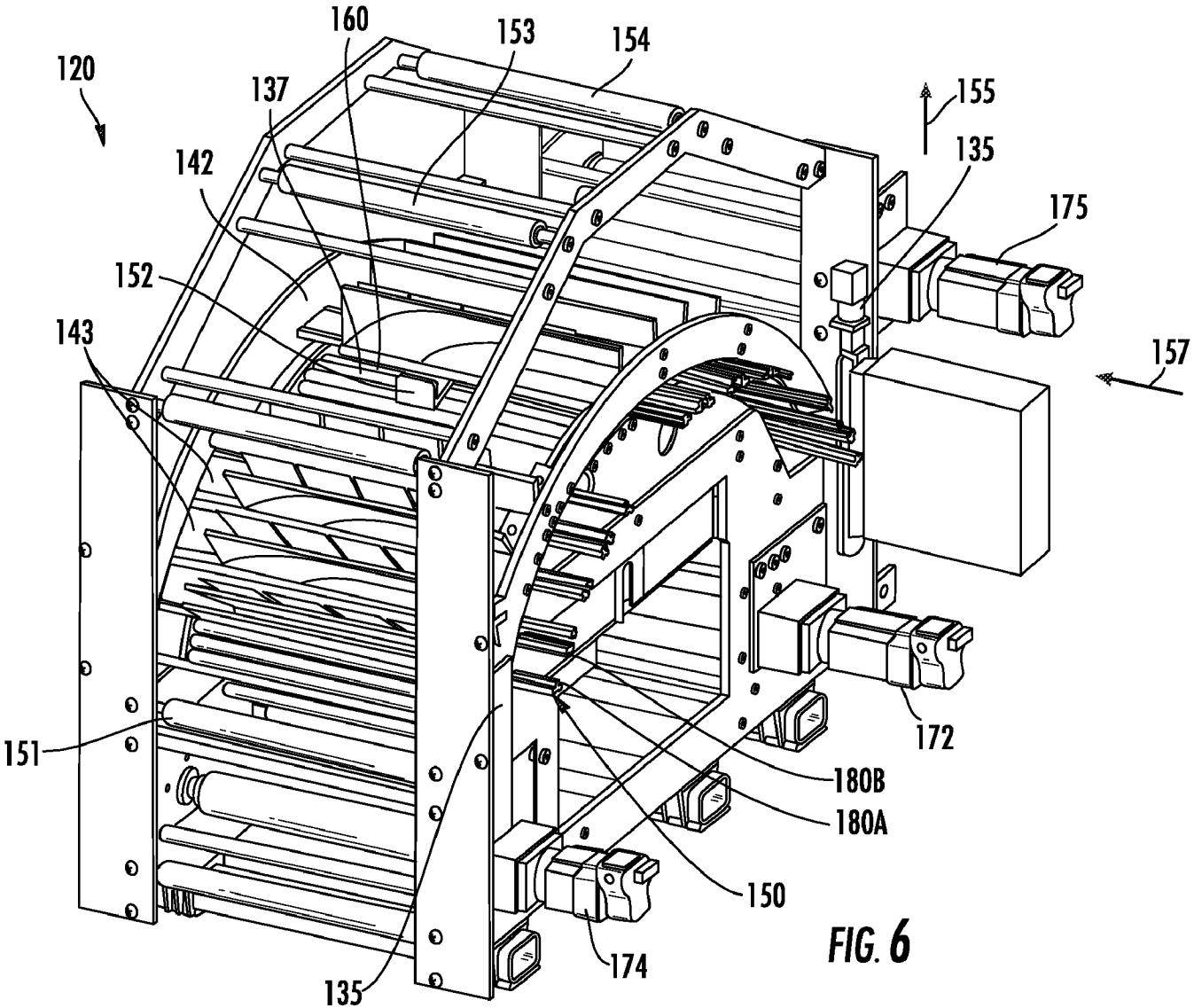
FIG. 6 is a top perspective view of the printer and dryer system of FIG. 4 and eight in head servicing position according to an example embodiment.

FIGS. 4-6 illustrate printing and drying system 120, another embodiment of printing system 20. Like printing system 20, printing and drying system 120 is configured to print upon a web of print media. Printing and drying system 120 is further configured to dry the printed image on the web of media. Like printing system 20, printing and drying system 120 facilitates the servicing of its print heads with a reduced footprint and with a reduced risk of misalignment of the print heads with the media being printed upon.

As shown by FIG. 4, system 120 includes print module 122 and dryer module 124, input 26 (shown in FIG. 1) and controller 28 (shown in FIG. 1). Print module 22 selectively deposits printing material upon web 130 to form an image, pattern, layout or arrangement of printing material upon web 130. In one embodiment, web 130 may comprise a web of printing material such as by cellulose-based media. In another embodiment, web 130 may comprise a web of polymeric material. In yet another embodiment, web 130 may comprise one or more other materials. In one embodiment, the printing material comprises a fluid such as one or more inks. In yet other embodiments, the printing material may comprise other types of fluid.

Print module 122 includes a printer 134, actuator 135, web flow path 136, including media support 137, web drive 138 and print head servicing system 140. Printer 134 comprises a device or mechanism configured to selectively deposit printing material. Printer 134 includes main support 142, print head supports 143 and one or more pens or cartridges 144. Support 142 comprises a structure configured to support cartridges 144 opposite to web 130. In the particular example illustrated, support 142 is configured to support cartridges 144 along an arc opposite to web 130. In the embodiment illustrated, support 142 is movable towards and away from web 130. In yet another embodiment, support 142 is stationary opposite to web 30.

Print head supports 143 comprise structures axially extending across the arc provided by main support 142, parallel to the centerline of the semi-cylindrical arc. Print head supports 143, sometimes referred to as print bars, extend across a width of media support 137 and support the one or more print cartridges 144. Supports 143 facilitate removal of cartridges 144 from main support 142 for repair or replacement of individual print cartridges 144 without removal of all of the print cartridges 144 from main support 142. In other embodiments where print cartridges 144 are directly supported by support 42, supports 143 may be omitted.

Cartridges 144 comprise mechanisms configured to eject fluid onto web 130. In the particular example illustrated, cartridges 144 each include one or more print heads 146 (schematically shown on one of cartridges 144). In one embodiment, print heads 146 each comprise thermal resistive drop-on-demand inkjet print heads. In yet other embodiments, print heads 146 may comprise piezo resistive inkjet print heads. In still other embodiments, print heads 146 may comprise other mechanisms configured to eject fluid in a controlled manner.

According to one embodiment, cartridges 144 each include a self-contained reservoir of fluid which is applied to the associated print heads 146. In yet another embodiment, cartridges 144 each include a reservoir which is further supplied with fluid or ink via an offer-axis ink supply system using one or more pumps or other mechanisms to supply a fluid to each of cartridges 144. In one embodiment, cartridges 144 of printer 134 are configured to apply multiple colors of ink. In the embodiment illustrated, cartridges 44 configured to deposit black (K), cyan (C), magenta (M) and yellow (Y) colored inks. In the example illustrated, printer 34 is additionally configured to apply a fixer (F) to web 130 prior to application of the colored inks. In other embodiments, printer 134 may include a fewer or greater of such cartridges configured to apply a fewer or greater of such different types of fluid.

Actuator 135 comprise a mechanism configured to selectively raise and lower support 142 to raise and lower cartridges 144 relative to web flow path 136 and web 130. As a result, support 142 may be moved to facilitate enhanced access to cartridges 144 for inspection, repair or replacement. In some embodiments, movement of support 142 and cartridges 144 may further facilitate servicing of print heads 146.

In the embodiment illustrated, actuator 135 comprises one or more hydraulic or pneumatic cylinder assemblies 147. In another embodiment, actuator 135 comprises one or more electric solenoids. In the yet another embodiment, actuator 135 may comprise one or more cams driven by one or more motors. In such an embodiment, support 142 may be guided by one or more guide rods or other guide structures. In still other embodiments, actuator 135 may be omitted.

Web flow path 136 comprises a path formed by one or more stationary or movable structures along which web 130 is guided and moved. In the particular example illustrated, web flow path 136 is formed by overhead rollers 150, 151, 152, 153, 154, 155, 156, 157 and 158, arcuately arranged rollers 160, forming media support 137, and control rollers 162, 164, 166. Rollers 150-158 guide and direct web 130 along path 36 over, around and about print support 42 and cartridges 44 generally to control roller 162. Although path 136 is illustrated as utilizing rollers 150-158 for directing web 130 over and around support 142, in other embodiment, path 136 may include a greater or fewer of such rollers for directing web 130 around support 142. In still other embodiments, other structures may be used to guide web 130 over and around support 142. For example, stationary structures such as arcuate panels or plates may be used to guide or direct web 130 around support 142.

Arcuately arranged rollers 160 form media support 137 and comprise a series of rotationally supported cylinders or rollers supported in an arc by a support 166 opposite to support 42 and cartridges 144. In one embodiment, support 166 supports rollers 160 which rotate about their individual axes. Rollers 160 facilitate relatively smooth movement of web 130 with minimal friction upon web 130. In other embodiment, rollers 160 may include a greater or fewer of such rollers or may include other structures configured to support web 130 in an arc opposite to support 142. For example, in another embodiment, rollers 160 may be replaced with one or more arcuate platens or plates.

Control rollers 162, 164 comprise independently rotationally driven rollers which define or form web flow path 136 and which move web 130 along web flow path 136. Roller 162 is located immediately upstream of cartridges 144 and their associated print heads 146. Roller 164 is located immediately downstream of cartridges 144 and their associated print heads 146 along web flow path 136. Rollers 162 and 164 form or define a printing zone across support 166 and rollers 160. Rollers 162 and 164 are configured to be driven at different speeds, facilitating adjustment of the tension of web 130 across an opposite to cartridges 144 during printing upon web 30. At the same time, rollers 162 and 164 may be driven at substantially the same speed, facilitating precise velocity control of web 130 across the printing zone formed by rollers 162, 164 and rollers 160.

Control roller 166 comprises an independently rotationally driven roller which further partially defined a farce web flow path 136. Control roller 165 engages or contacts web 130 after web 130 has left printer model 122 and has passed through dryer module 124. In operation, control roller 165 pulls web 130 partially through dryer module 124 despite being physically associated with printer model 122. Because printer module 122 includes control roller 165, the cost and complexity of dryer model 124 is reduced. Likewise, control of the velocity of control roller 165 may be more easily facilitated using controller 28 (shown and described with respect to FIG. 1) which is also physically associated with print module 122. In other embodiment, control roller 165 may alternatively be provided as part of dryer module 124.

As further shown by FIG. 2, each of control rollers 162 and 166 is preceded and succeeded by additional guide rollers 169. Guide rollers 169 facilitate wrap of web 130 about control rollers 162 and 165. In other embodiment, such additional guide rollers 169 may be omitted.

As further shown by FIG. 2, web flow path 136 is inverted multiple times. In particular, when entering print model 122, web flow path 136 is flowing in a first direction as indicated by arrow 170. At roller 158, the direction in which web 130 is moving is inverted such that web 130 is redirected and moves in a second opposite direction as indicated by arrow 171. Web flow path 136 continues in an arc over rollers 160 opposite to cartridges 144 until it is once again inverted at roller 164 to once again flow in the direction indicated by arrow 170. Web flow path 136 continues to flow "downstream" in the direction indicated by arrow 170 until leaving print module 122 for a first time prior to reentering print module 122 at control roller 165 after being dried by dryer module 124.

Web drive 138 comprises one or more mechanisms configured to rotationally drive rollers 162, 164 and 165. In the example illustrated, web drive 138 comprises stepper motors 172, 174 and 175 (with associated encoders). In other embodiments, web drive 138 may comprise other controllable sources of torque. In still other embodiments, web drive 138 may comprise a single motor configured to selectively supply distinct levels of torque or velocity to rollers 162, 164 and 165 using one or more transmissions and clutch mechanisms.

Print head servicing system 140 includes guides 150 and printed service shuttles 152. Guides 150 comprise one or more structures configured to died, support and direct movement of service shuttles 152 across media support 137 to positions opposite to print heads 146 for servicing of print heads 146. Guides 150 are each dedicated to an associated with particular print head supports 143 and their associated cartridges 144. In the example illustrated, guides 150 are coupled to and provided as part of print head supports 143. As a result, print head supports 143 and the associated guides 150 may be assembled an inventory as individual units. In addition, such individual units may be more easily separated and removed from main support 142 for repair or replacement. According to one example embodiment, guides 150 comprise C-shaped tracks or channels in and along which rulers or other low friction bearing structures associated with service shuttles 152 rotate, slide or otherwise translate. In other embodiments, guides 150 may comprise other structures for guiding movement of service shuttles 152 across media support 137 to positions opposite to print heads 146. Although guides 150 are illustrated as being provided on opposite sides of each of print head supports 143, in other embodiments, guides 150 may alternatively extend along a single side of each of print head supports 143 or at a single intermediate location between opposite sides of print head support 143.

Service shuttles 152 comprise devices configured to move along guides 150 between a servicing positioned and a withdrawn position for printing. Servicing shuttles 152 are configured to perform one or more servicing operations, such as wiping, spitting and capping, upon print heads 146. As schematically shown in FIG. 1, each service shuttle 152 is associated with an actuator 154 configured to serve as a shuttle drive for moving the associated shuttle 152 between the servicing position and the withdrawn position. In particular come each actuator 154 is configured to linearly translate its associated service shuttles 152 along the one or more guides 150.

In one embodiment, each actuator 154 may be supported and carried by its associated service shuttles 152. In another embodiment, portions of the actuator 154 may be stationary and operably coupled to service shuttles 152. According to one embodiment, actuator 154 comprises a rack gear extending along each of guides 150 and pinion gear carried by service shuttles 152 in engagement with the rack gear, wherein rotation of the pinion gear, such as by a motor carried by service shuttle 152, moves the individual service shuttle 152 along the rack gear and along the associated guide 150. In another embodiment, actuator 154 may have other configurations.

FIGS. 5 and 6 illustrate operation of printing and drying system 120. FIG. 5 illustrates a printing system 120 in a printing mode. As shown by FIG. 5, controller 28 (shown in FIG. 1) generates control signals directing actuator 135 to lower main support 142 (shown in FIG. 1) which lowers individual print head supports 143 and their associated pens or cartridges 144 to a lowered printing position in which print heads 146 are closely spaced to web 130 supported by media support 137. In the particular example illustrated, print heads 46 from web 30 by a gap. In one embodiment, the gap is less than or equal to about 3 mm. In other embodiments, this gap may have other dimensions. Controller 28 further generates control signals directing cartridges 144 and print heads 146 to deposit a printing material upon web 130.

At the same time, service shuttle 152 is moved by actuator 154 to a withdrawn position as shown in which service shuttles 152 is withdrawn from or not opposite to either web 30 or print heads 146. In one embodiment, each service shuttle 152 has a height greater than the distance of gap, enabling printing without interference from service shuttles 152.

FIG. 6 illustrates printing system 120 in a print head servicing mode. In response to commands received via input 26 (shown in FIG. 1) or based upon stored instructions or stored parameters, controller 28 (shown in FIG. 1) generates control signals initiating servicing. In one embodiment, controller 28 may of instructions stored in memory that automatically initiate the servicing mode upon the lapse of a predetermined amount of time, at predetermined times, or based upon usage of printing and drying system 120, such as the amount of printing material used or the amount of web 130 that is printed upon, exceeding an input or stored threshold.

As shown in FIG. 6, controller 28 initiates servicing by generating control signals directing actuator 135 to lift or raise one or more a print head supports 134 in the direction indicated by arrow 155 from the lowered printing position shown in FIG. 5 to the raised position shown in FIG. 6. In the raised position, print heads 146 are spaced from web 130 by a distance greater than the height of service shuttle 152. In one embodiment, actuator 135 raises main support 142 which causes all of the associated print heads 143 and their associated print heads 146 to be moved to the raised position in unison. In other embodiments, a separate actuator may be associated with each print head support 143 to individually and independently raise print heads 143 for individual and independent servicing by service shuttles 152. In such an embodiment, some of print heads 146 are serviced while others continue to print upon web 130.

Once print head support 134 has been moved to the raise position shown in FIG. 6, controller 28 generates control signals directing actuator 154 to move service shuttle 152 in the direction indicated by arrow 157 to the servicing position shown in FIG. 3 in which service shuttle 52 extends opposite to the print heads 146 to be serviced, sandwiched between the print heads 146 to be serviced and web 30. Once positioned across from print heads 146, service shuttle 152 performs the one or more servicing operations upon the print heads.

Upon completion of the servicing operations, controller 28 generates control signals directing actuator 154 to retract service shuttle 152 to the withdrawn position shown in FIG. 5. Thereafter, controller 28 generates control signal stretching actuator 135 to once again lower print head support 143 and cartridge 144 to printing position shown in FIG. 5, ready for printing.

As with printing system 20, because printing system 120 raises and lowers one or more of print and supports 143 between the lowered printing position shown in FIG. 5 and the raised servicing position shown a FIG. 6, service shuttle 152 may be provided with a height greater than the printing gap. Because service shuttle 152 is moved between the withdrawn position shown in FIG. 5 and the servicing position shown in FIG. 6, servicing of print heads 146 may performed without sideways or lateral movement of print heads 46 and without repositioning of web 130. As a result, printing misalignment issues are reduced and printing system 120 is more compact.

Figure 7:
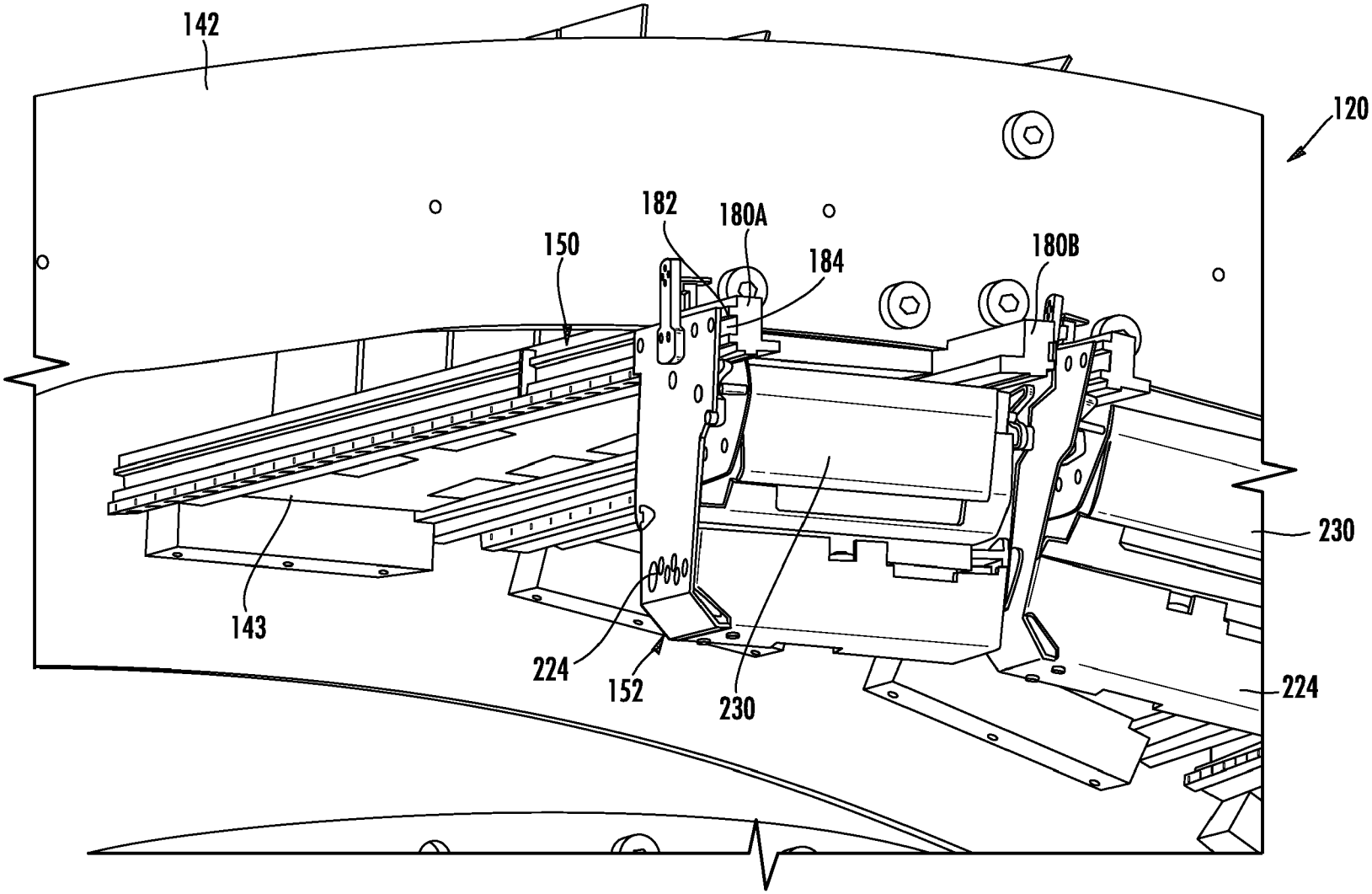
FIG. 7 is an enlarged bottom perspective view of a servicing system of the printer and dryer system of FIG. 4 according to an example embodiment.

FIGS. 7-18 illustrate servicing system 140 in more detail. In particular, FIG. 7 illustrates guides 150 in more detail will FIGS. 8-17 illustrate one of service shuttles 152 in more detail. As shown by FIG. 7, each guide 150 associated with a service shuttle 152 includes a pair of opposite rails 180A and 180B (collectively referred to as rails 180) connected directly to an associated with print head support 143 such extent on opposite sides of the print heads 146 (shown in FIG. 5) supported by the print head support 143. Each of rails 180 includes an outwardly facing C-shaped channel or track 182 configured to receive a roller or other bearing 184 associated with service shuttle 152 to facilitate movement of the service shuttle 152 along the track 182. In other embodiments, this relationship may be reversed. For example, in other embodiment, each of rails 180 may include a projecting wheel, roller or other bearing structure which roles, slides of ice moves within a corresponding inwardly facing channel or track associated with service shuttle 152. In still other embodiment, service shuttle 152 may alternatively be movably joined to rails 180 on an inner surface of rails 180 rather than the outer surface.

Figure 8:
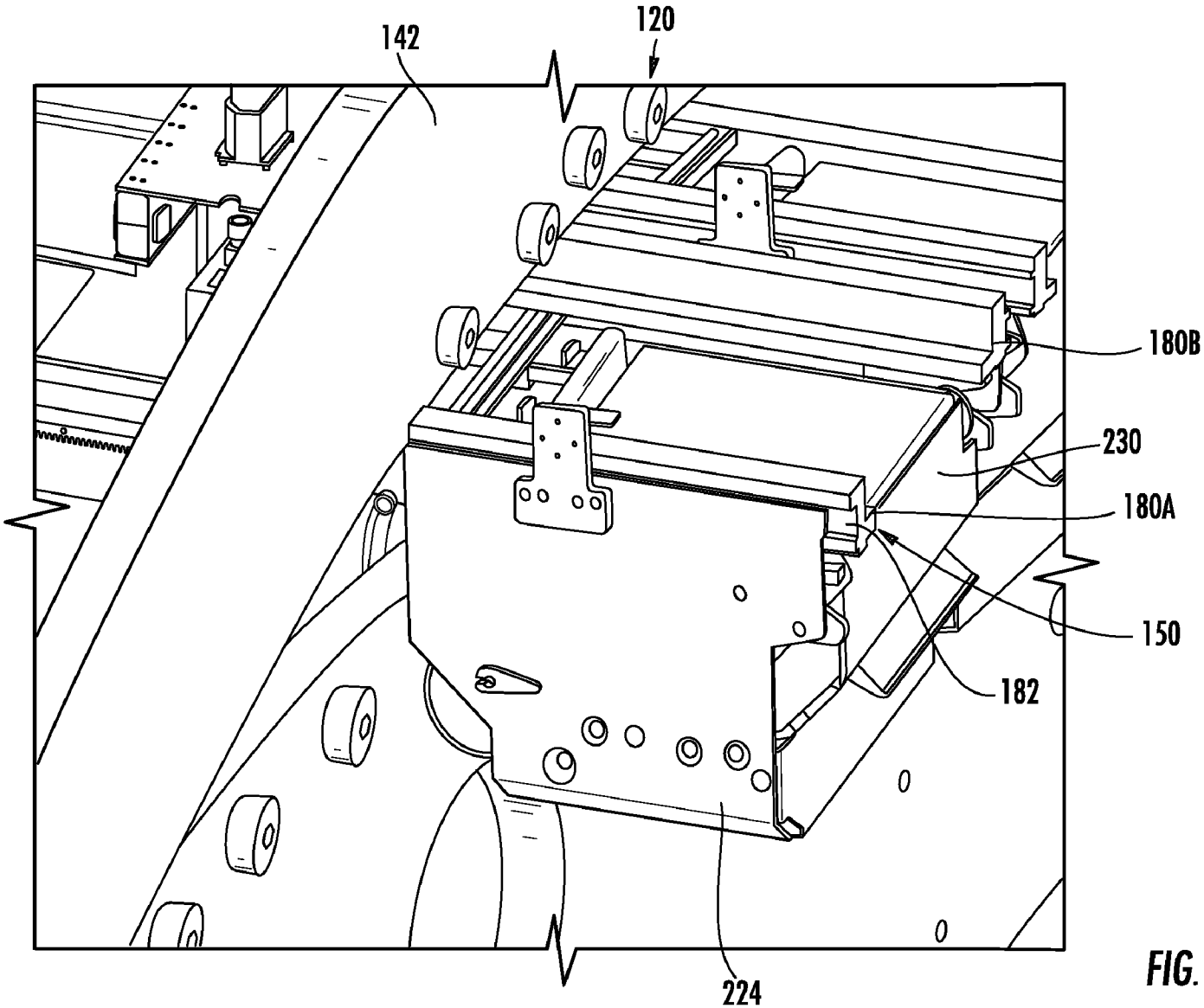
FIG. 8 is an enlarged fragmentary top perspective view of the servicing system of FIG. 7 according to an example embodiment.
Figure 9:
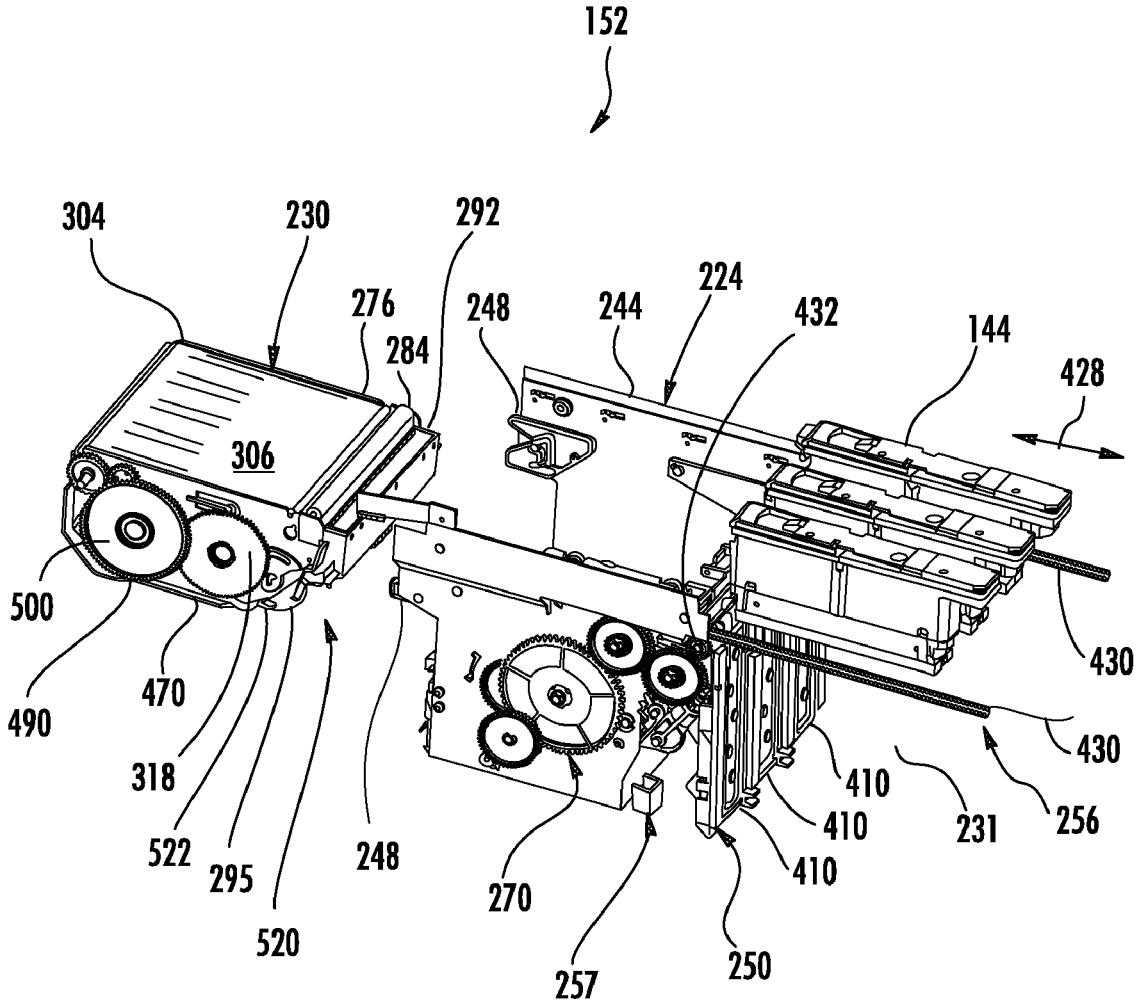
FIG. 9 is a top perspective view of another embodiment of a service shuttle of the servicing system of FIG. 7 according to an example embodiment.

FIGS. 8-18 illustrate service shuttle 152 in more detail. FIG. 8 illustrates a service shuttles 152 mounted upon rails 180. FIGS. 9-18 illustrate service shuttle 152 without rails 180. FIGS. 9-10 and 15-18 further illustrate relative positioning of cartridges 144 with respect to upper portions of service shuttle 152. As shown by FIG. 9, service shuttle 152 includes a dock or service station 224 and a service cartridge 230.

Service station 224 securely receives and supports cartridge 230 and is movable with respect to housing 12 to position cartridge 230 in space 231 opposite to print heads 146 for servicing print heads 146. Service station 224 includes frame 244, latches 248, capper 250, actuator 252 (shown in FIGS. 5 and 8), torque source 254 (shown in FIG. 5), actuator 154 and payout sensor 257. Frame 244 comprises one or structures configured to removably receive cartridge 230. Frame 244 further supports remaining components of service station 224. In the example illustrated, frame 244 is itself movably supported with respect to guides 150 by actuator 154.

Figure 11:
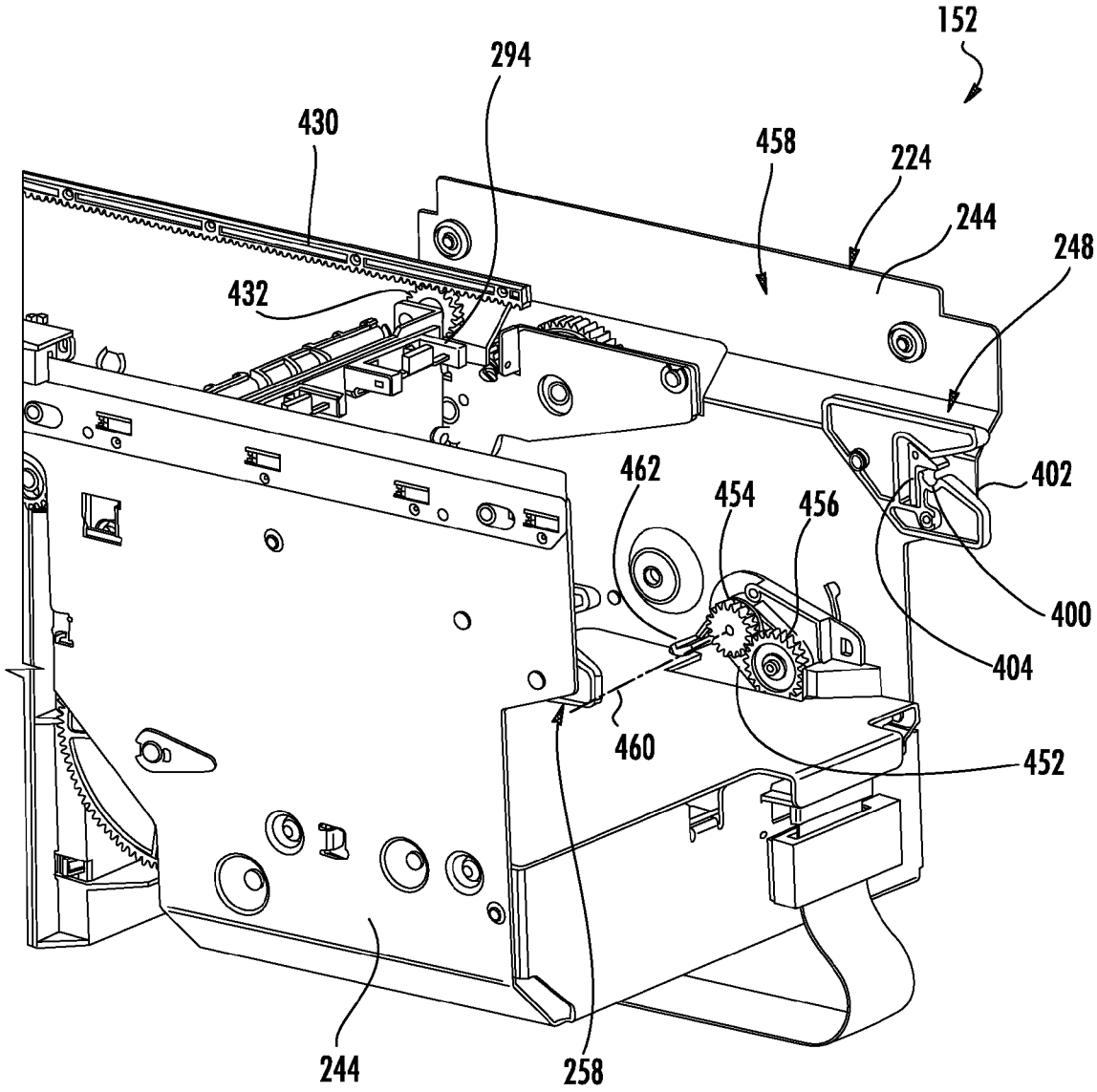
FIG. 11 is a fragmentary top perspective view of the system of FIG. 9 illustrating a service station prior to reception of a service cartridge according to an example embodiment.

Latches 248 comprise a pair of mechanisms associated with frame 244 and configured to releasably secure cartridge 230 with respect to frame 244. FIG. 11 illustrates one of latches 248 in more detail. As shown by FIG. 11, latch 248 includes detent 400, mouth 402 and retaining member 404. Detent 400 comprises a depression configured to rotatably or pivotably receive a connecting portion such as a shaft or other projection of cartridge 230 to secure cartridge 230 to service station 224 and to permit cartridge 230 to pivot relative to service station 224. Mouth 402 comprises an opening leading to detent 400 facilitating insertion of a connection portion of cartridge 230 into detent 400. Retaining member 404 comprise a structure resiliently cantilevered opposite to detent 400 such capture the connecting portion of cartridge 230 in detent 400 as will be described in detail hereafter. Latches 248 permit the portion of cartridge 230 to be easily inserted with a lower insertion force. At the same time, latches 248 resist extremely large horizontal forces to securely retain cartridge 230 in service station 24. Latches 248 also retain cartridge 230 against moderate lifting forces and release cartridge 230 when a vertical lifting force exceeds a predetermined threshold, wherein retaining member 404 allows free extraction of cartridge 230 horizontally.

Figure 10:
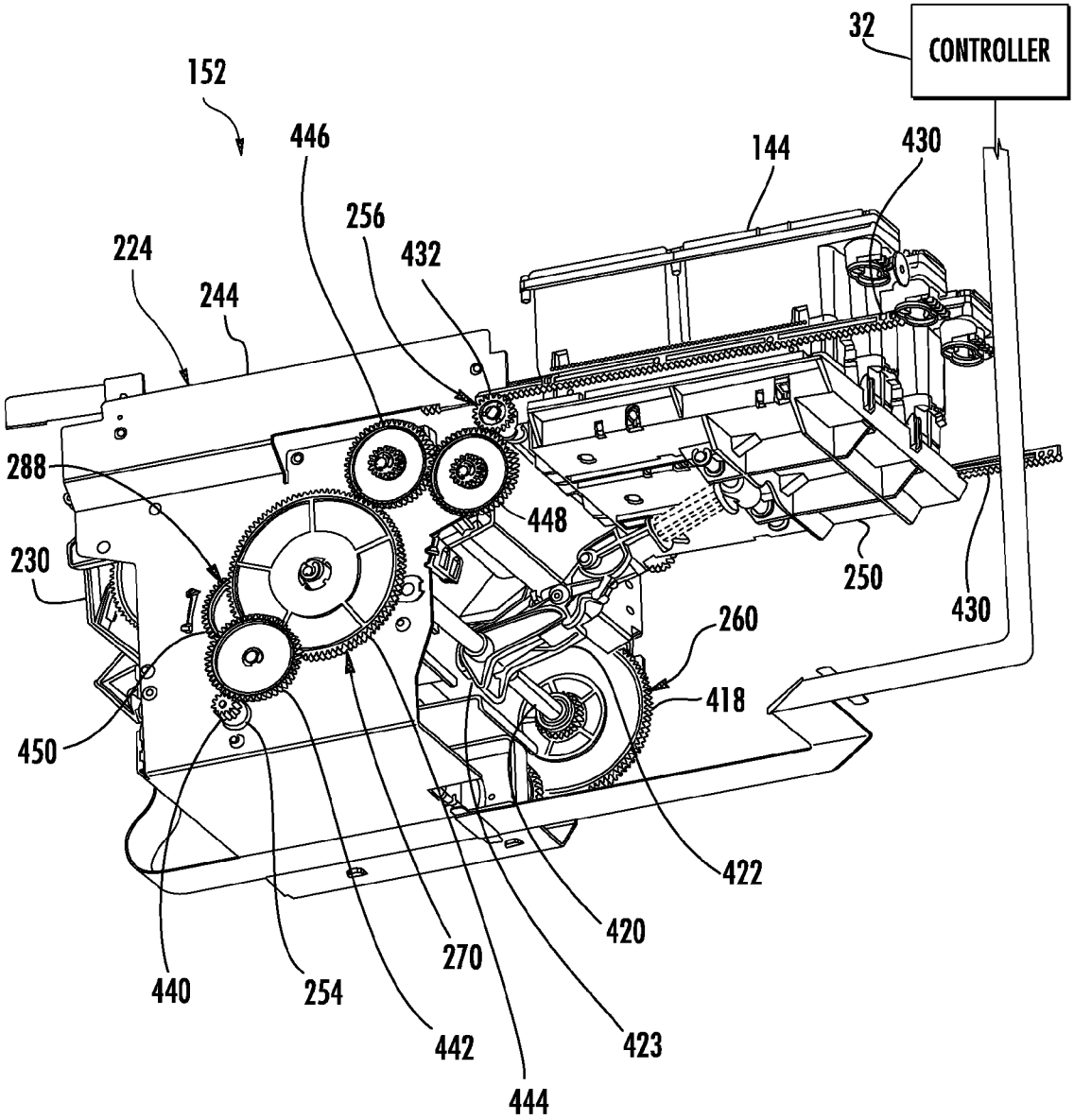
FIG. 10 is a bottom perspective view of the system of FIG. 9 illustrating positioning of a capper in a capping position according to an example embodiment.

Capper 250 comprises a mechanism configured to cap or seal the nozzles of print heads 146 when print heads 146 are not being used. As shown by FIG. 9, capper 250 includes elastomeric rims or walls 410 configured to be held or pressed against a face of each of print heads 146 opposite to the nozzles of print heads 146 as shown in FIG. 10.

Figure 15:
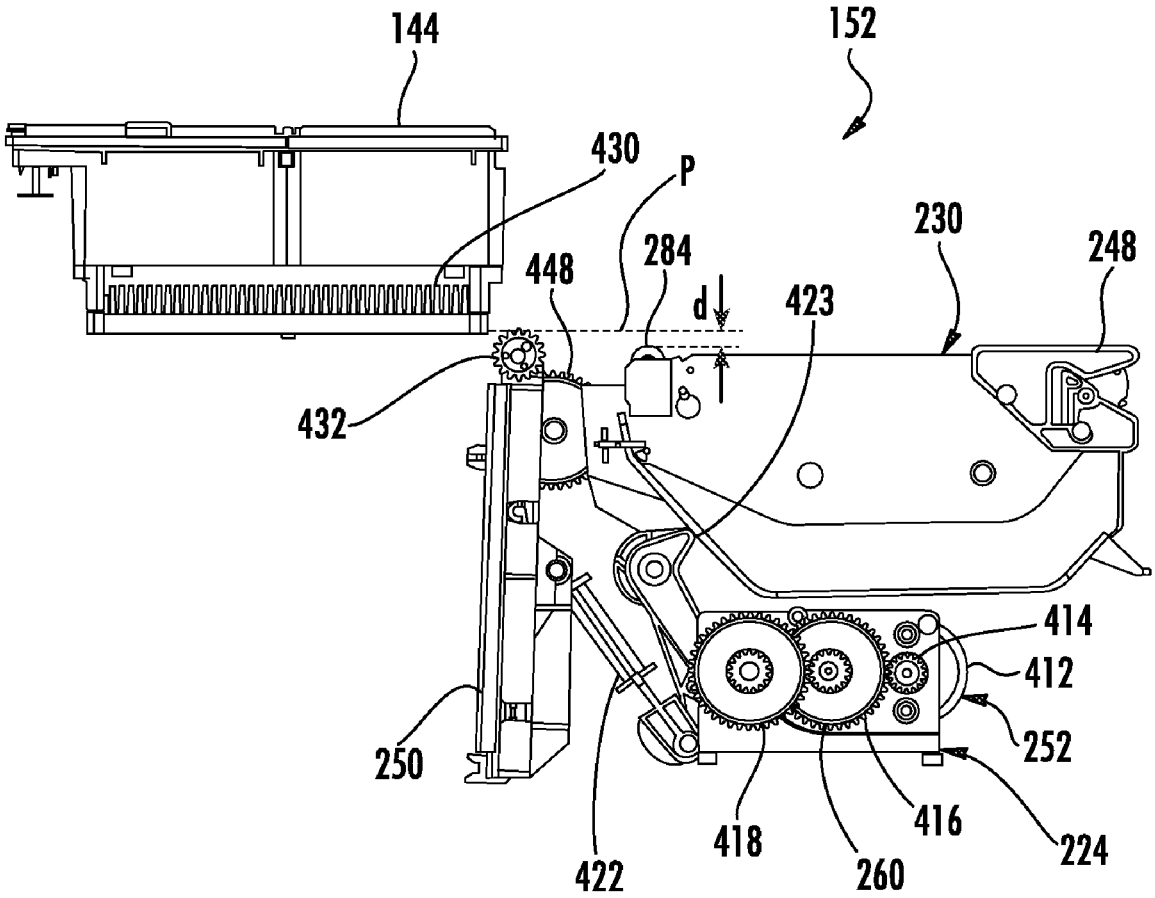
FIG. 15 is a side elevational view illustrating a cartridge in a non-wiping position according to an example embodiment.

Actuator 252 comprises a mechanism configured to pivot capper 250 between a capping position (shown in FIG. 10) and a printing or servicing position (shown in FIG. 9). In the example illustrated, actuator 252 includes torque source 412 (shown in FIG. 12) and drive train 260 (shown in FIGS. 9 and 15). As shown by FIG. 15, torque source 412 has an output shaft connected to an output gear 414. Gear 414 drives cluster gear 416 which further transmits torque to cluster gear 418. As shown by FIG. 9, cluster gear 418 is fixed to shaft 420 which a secured to clamping linkage 422. Clamping linkage 422 comprises a series of linkages configured to hold and retain capper 250 against print heads 146 when power to drive train 260 from torque source 412 is ceased. Selective rotation of gear 414 by torque source 412 results in capper 250 being moved between the capping position shown in FIG. 3 and the printing or servicing position shown in FIG. 9.

Figure 16:
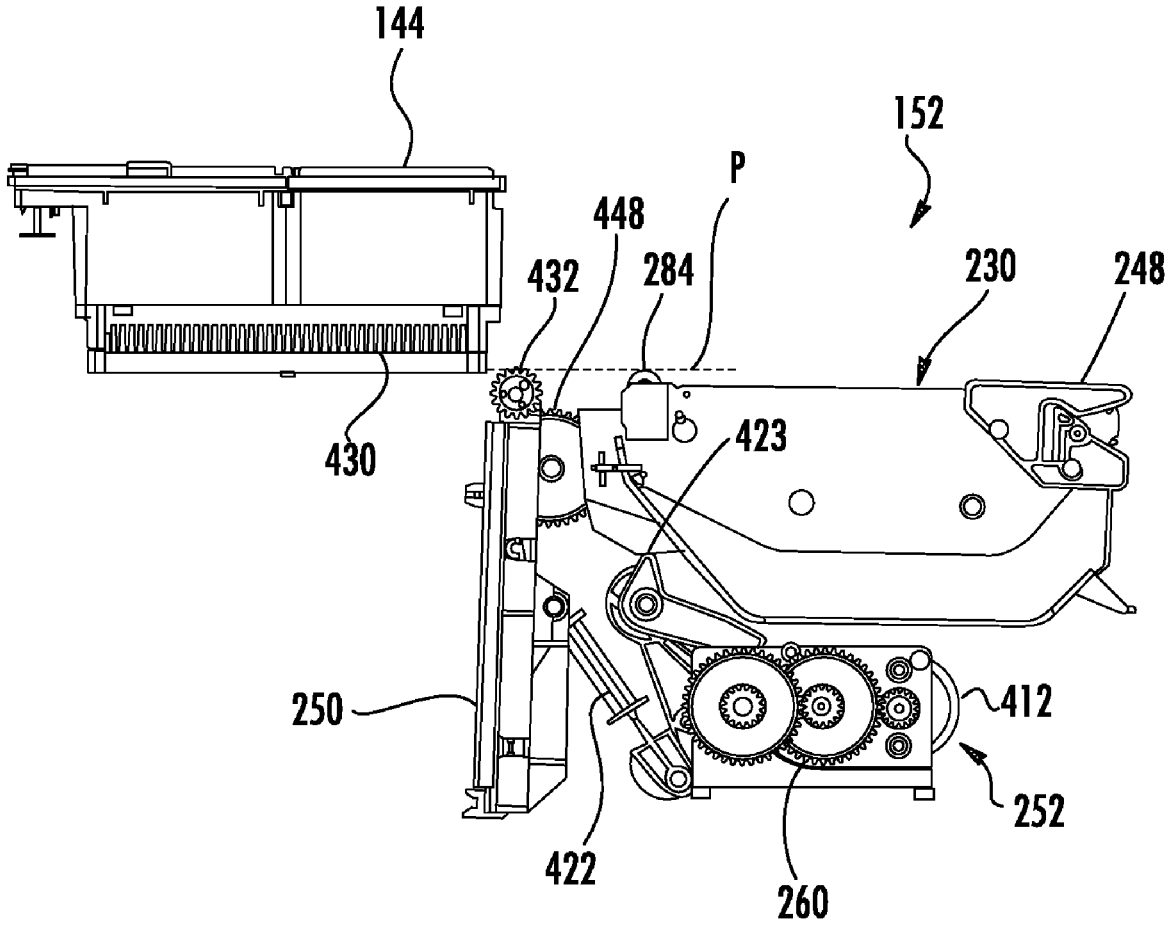
FIG. 16 is a side elevational view of the cartridge in a wiping position according to an example embodiment.
Figure 17:
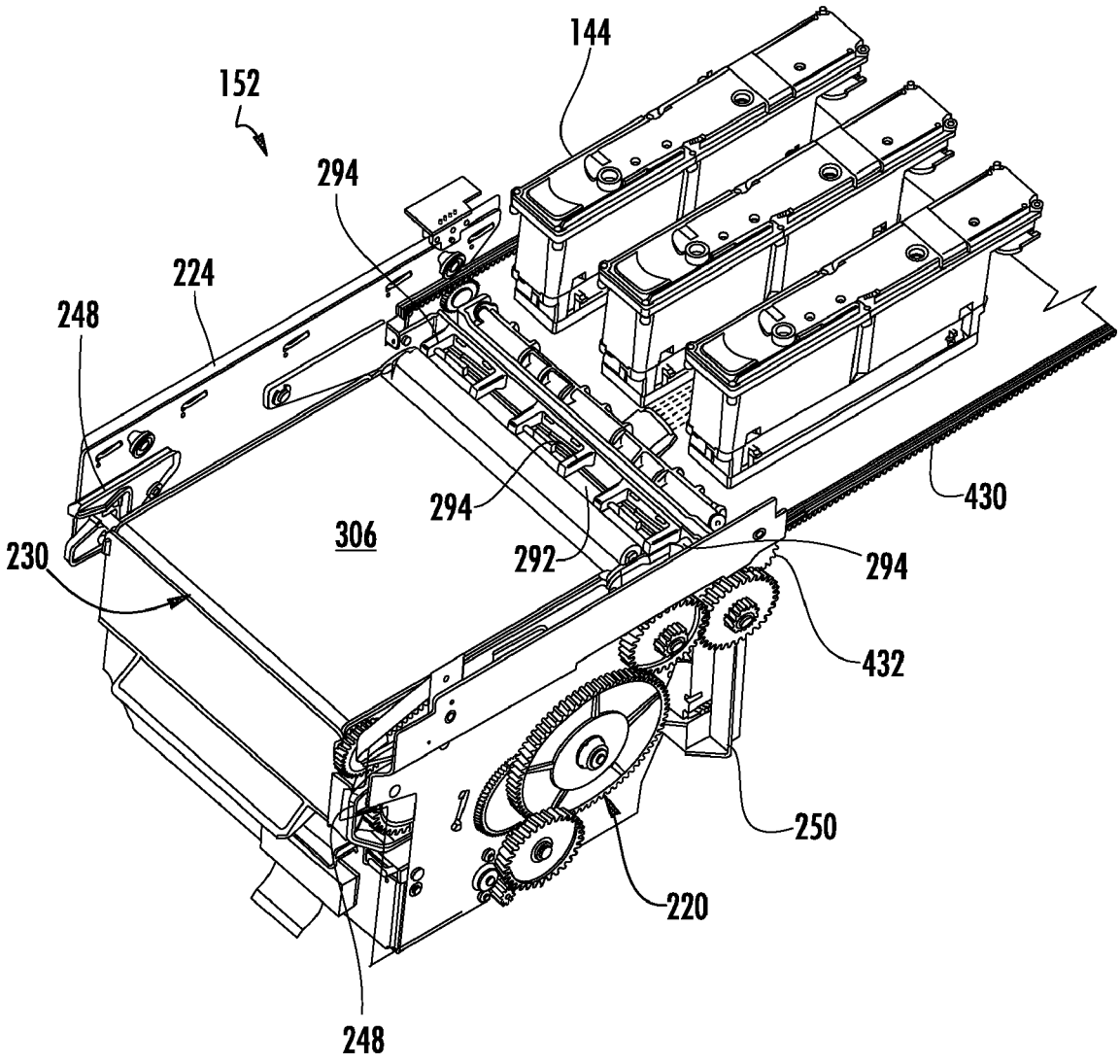
FIG. 17 is a fragmentary top perspective view of the cartridge inserted into the service station of the system of FIG. 9 according to an example embodiment.

In the example illustrated, actuator 252 is configured to further pivot service cartridge 230 between a lowered position (shown in FIG. 15) in which the plane p tangent to the top of support 284 is below the faces of the nozzles of print head 220 by a distance d and a raised wiping position (shown in FIG. 16). As shown in FIG. 10, service station 224 additionally includes cam 423 secured to shaft 420. To pivot cartridge 230 to the wiping position, controller 32 (shown in FIG. 10) generates control signals directing torque source 412 (shown in FIG. 15) to supply torque to shaft 420 (shown in FIG. 10) of drive train 260 so as to rotate cam 423 from the lower positioned shown in FIG. 15 to a lifting positioned shown in FIG. 16. As a result, material 304 supported by support 284 is lifted to extend slightly above nozzles of print heads 146. As a result, movement of service station 224 and cartridge 230 results in material 304 supported by support 284 being wiped across the face of the nozzles of print heads 146 along the plane p.

Torque source 254 (shown in FIG. 12) comprises a source of rotational force or torque operably coupled to cartridge 230 so as to drive elements of cartridge 230. In the example illustrated, torque source 254 comprises a DC stepper motor. In other embodiments, torque source 254 may comprise other sources of torque.

Actuator 154 comprises a mechanism configured to linearly move service station 224 in either of directions indicated by arrows 428 shown in FIG. 9. In the example illustrated, actuator 154 includes rack gears 430 and pinion gears 432. Rack gears 430 are coupled to frame 12 and extend along opposite sides of space 231. Pinion gears 432 are rotatably supported by frame 244 of service station 224 and are in meshing engagement with rack gears 430 such that rotation of pinion gears 432 results in service station 224 moving along rack gears 430 into and out of space 231.

As shown by FIG. 10, pinion gear 432 of actuator 154 are operably coupled to torque source 254 by drive train 270. In particular, drive train 270 includes gear 440 secured to an output shaft of torque source 254. Gear 440 is in meshing engagement with cluster gear 442 which is in meshing engagement with cluster gear 444. Cluster gear 444 is in meshing engagement with gear 446 which is in meshing engagement with gear 448. Gear 448 is in meshing engagement with pinion gear 432 to complete the drive train connection between torque source 254 and pinion gear 432. In other embodiments, drive train 270 may include other torque transferring arrangements such as belt and pulley arrangements, chain and sprocket arrangements or combinations thereof.

Figure 12:
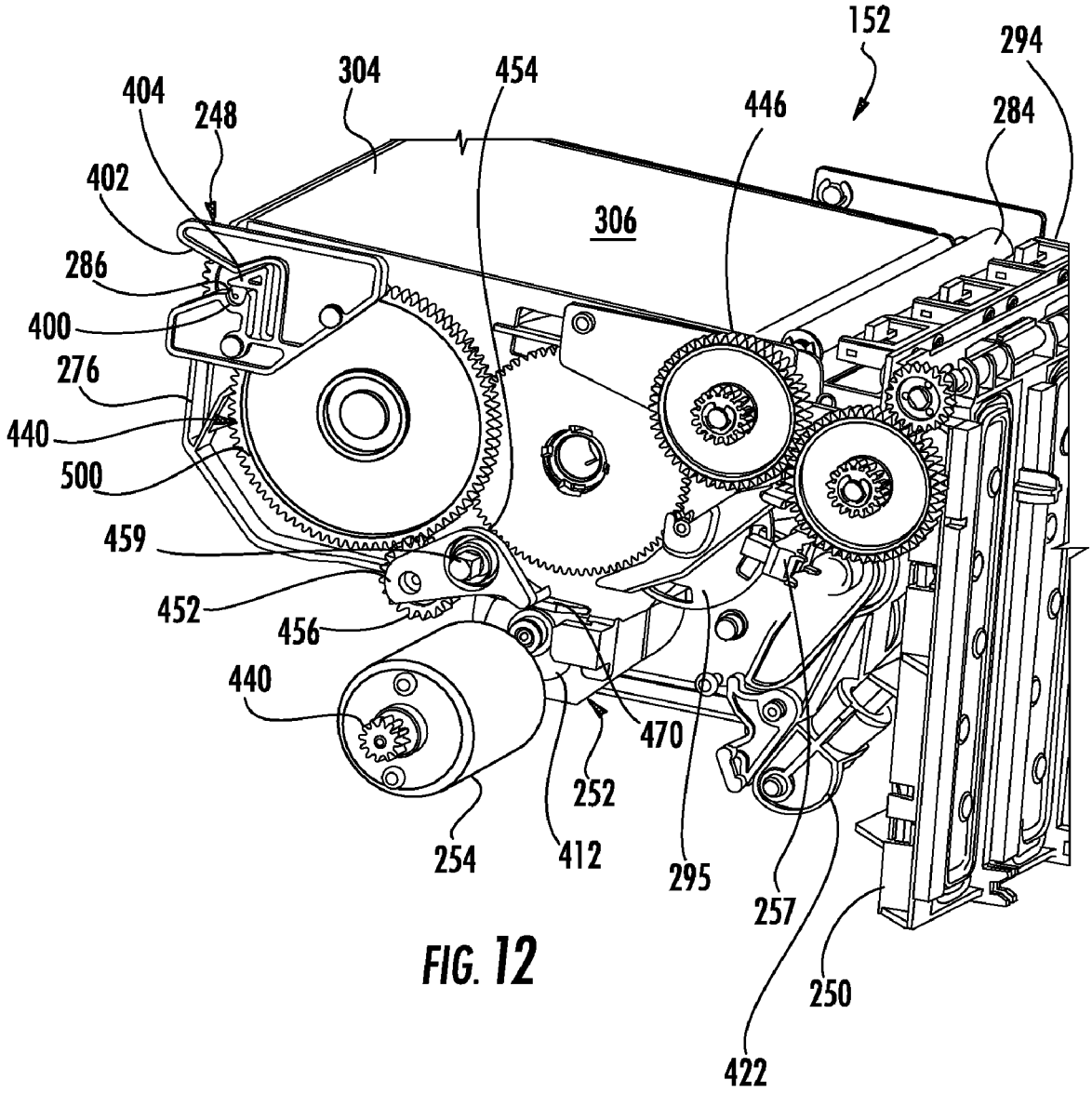
FIG. 12 is a fragmentary top perspective view illustrating the service cartridge positioned within the service station with portions of the service station omitted for purposes of illustration according to an example embodiment.

FIGS. 10-12 illustrate transmission of torque from torque source 254 to service cartridge 230 by drive train 288. As shown by FIG. 10, drive train 288 shares gears 440, 442 and 444 with drive train 270. Drive train 88 further includes gears 450, rocker 452, gear 454 and gear 456. Gear 450 is rotatably supported by frame 244 and is in meshing engagement with gear 444. Gear 450 is connected to a shaft 459 (shown in FIG. 12) passing through frame 244 (removed in FIG. 12 for purposes of illustration) to gear 454 which is located on an interior 458 of station 224. Rocker 452 comprises an arm pivotably connected to frame 244 for pivotal movement about axis 460. Rocker 452 includes a projection or tab 462 configured to cooperate with cartridge 230 so as to control pivoting of rocker 452 and gear 456 into and out of engagement with a portion of drive train 288 associated with cartridge 230 as will be described hereafter. Gear 456 is rotatably supported by rocker 452 and is in meshing engagement with gear 454. Gear 456 is configured to be in meshing engagement with a gear of drive train 288 associated with cartridge 230. As will the described hereafter, gear 456 is further configured to be pivoted out of engagement with a gear of cartridge 230 when cartridge 230 is pivoted to a wiping position. Because torque source 254 supplies torque for both linear movement of service station 224 and for driving components of service cartridge 230, system 210 has fewer parts, is more compact and is less costly.

Payout sensor 257 comprises a sensing device configured sense payout of material 304 and to detect the presence of cartridge 230 and service station 224. In one embodiment, sensor 257 comprises an optical sensor having and emitter and a corresponding detector, wherein transmission of light from the emitter, such as an optical beam, is interrupted by a portion of cartridge 230 upon its insertion. Sensor 257 communicates signals representing the presence of cartridge 230 and payout of material 304 to controller 32 to facilitate generation of status signals or warnings regarding the operational status of print system 210.

Figure 13:
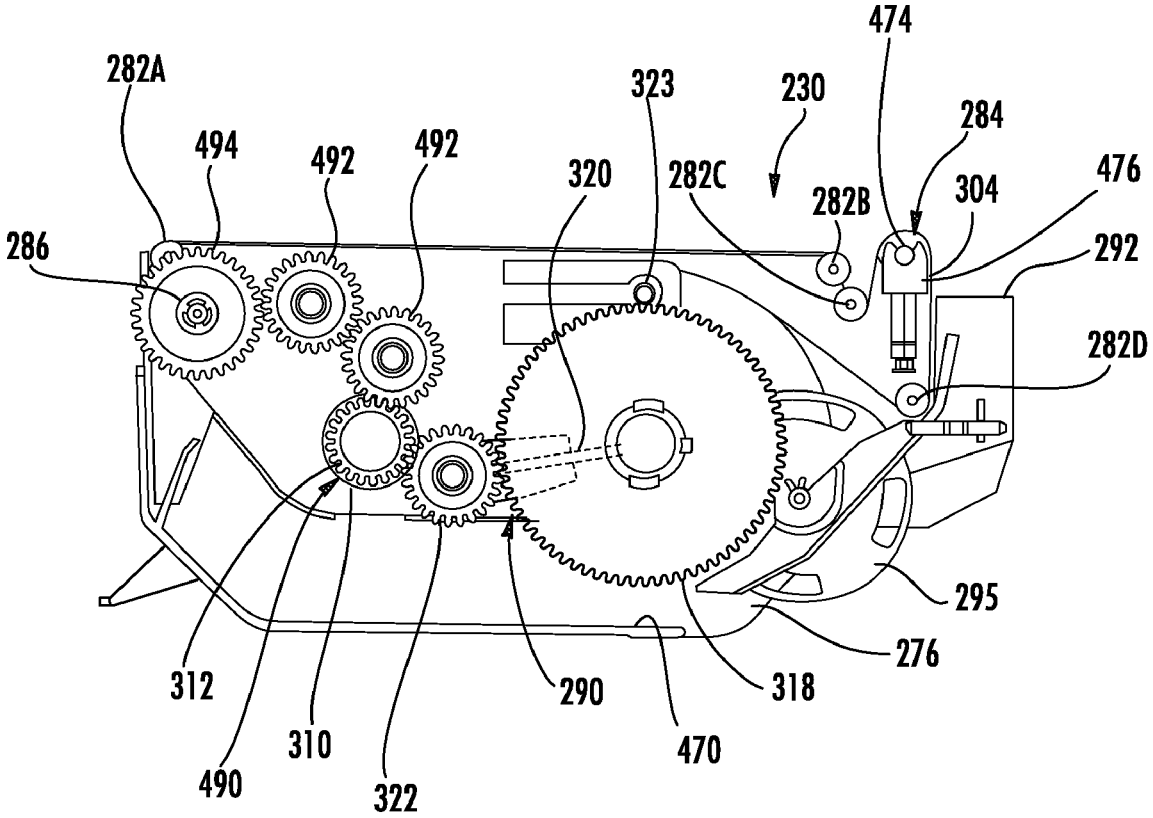
FIG. 13 is a side elevational view of a cartridge of the system of FIG. 9 with portions of the cartridge omitted for purposes of illustration according to an example embodiment.
Figure 14:
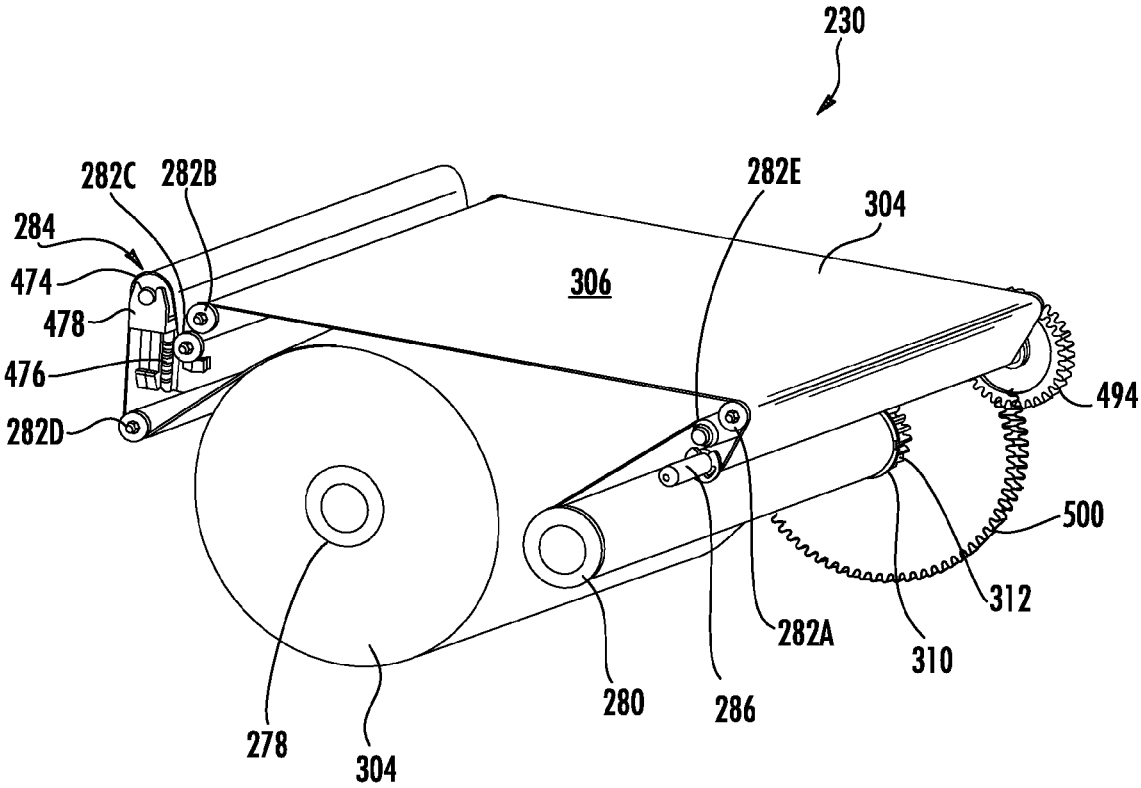
FIG. 14 is a top perspective view of a portion of the cartridge of FIG. 13 illustrating a web path according to an example embodiment.

Cartridge 230 is configured to receive ink or other fluid from print heads 146 to determine the status of each the nozzles of print heads 146, to wipe the nozzles of print heads 146 and to receive ink or fluid during spitting or priming of the nozzles of print heads 220. As shown by FIG. 9, cartridge 230 is removable from station 224 for repair, replacement or refurbishment. As shown by FIGS. 9, 13 and 14, cartridge 230 includes housing 276, supply core 278, take-up core 280, supports 282A, 282B, 282C, 282D and 282E (collectively referred to as supports 282), support 284, input shaft 286, portions of drive train 288, a drop detection basin 292 (shown in FIG. 9), sensors 294 (shown in FIG. 17) and payout indicator 295.

Housing 76 comprises one or more structures configured to support and retain the remaining components of cartridge 230. As shown by FIGS. 9 and 12, housing 276 includes a lower side rail 470. Side rail 470 extends from transverse side of cartridge 230 and extends below tab 462 of rocker 452 when cartridge 230 is inserted into interior 458 of station 224. Side rail 470 is configured to engage and pivot tab 462 of rocker 452 so as to disengage gear 456 from portions of drive train 288 associate with cartridge 230 when cartridge 230 is pivoted by actuator 252 to the wiping position. As a result, that portion of drive train 288 associated with service station 224 that is utilized to transfer power to pinion gear 432 of actuator 154 may be driven to move service station 24 back and forth during wiping, or other repositioning of service station 224 while cartridge 230 is raised to a wiping position without the substantial release or unwinding of material 304. In other embodiments, rail 470 may be positioned in other locations and may have other configurations depending upon location and configuration of rocker 452.

Supply core 278 (shown in FIG. 14) comprises a spool or spindle rotatably supported by housing 276 and configured to support windings of material 304. Material 304 is substantially similar to material 104 described above. Take-up core 280 comprises a spool or spindle rotatably supported by housing 276 and configured to take up used material 304.

Figure 18:
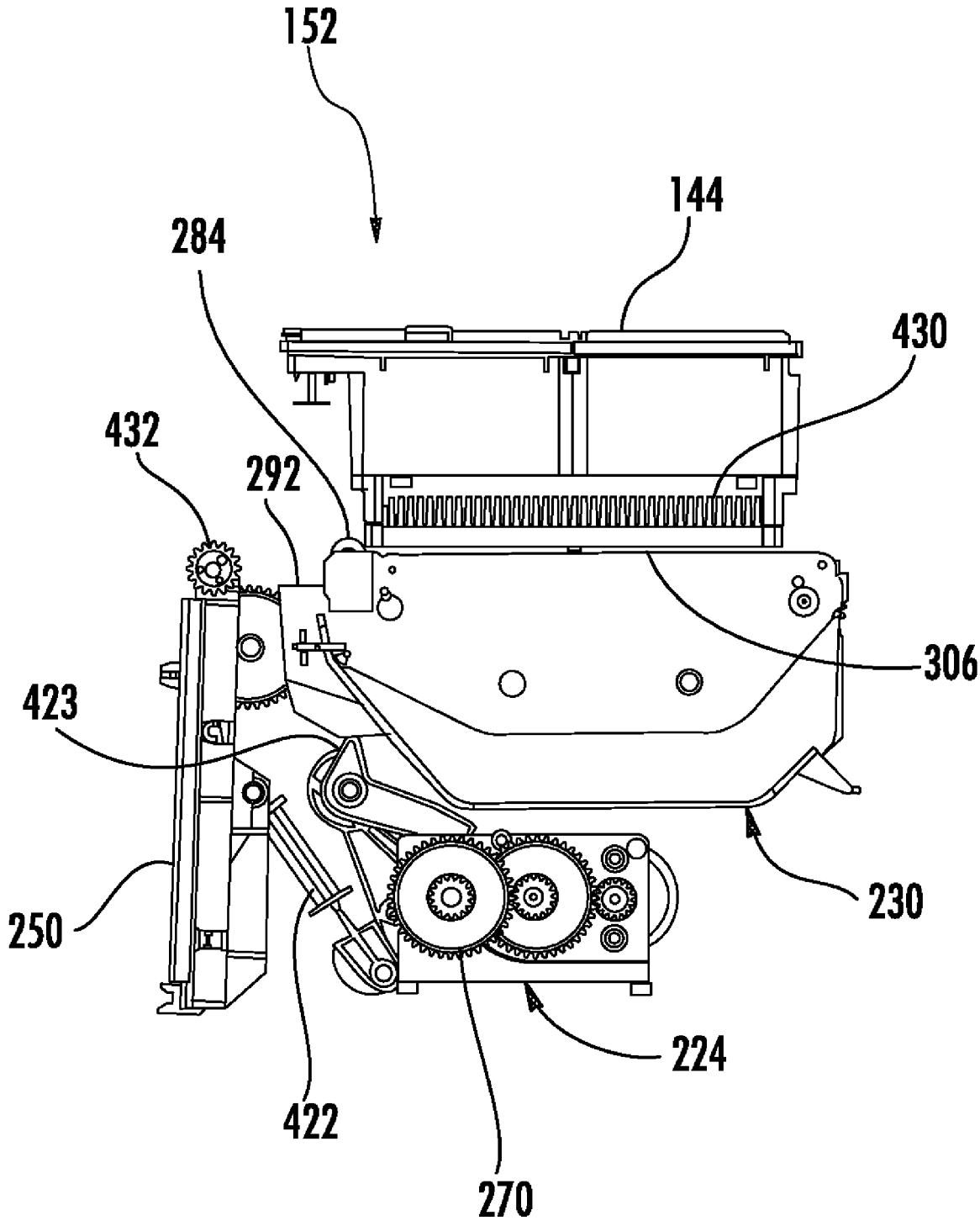
FIG. 18 is a side elevational view of the cartridge of the system FIG. 9 illustrating the cartridge positioned opposite print heads during priming or spitting according to an example embodiment.

Supports 282 comprise structures to guide and direct the web of material 304. As shown in FIG. 14, supports 282 comprise idler shafts in the embodiment illustrated. Support 282A and 282B stretch the webbing of material 304 to form spitting area 306. Spitting area 306 is substantially similar to spitting area 106 described above with respect to system 10. As shown in FIG. 18, for spitting or priming of the nozzles of print heads 220, controller 32 generates control signals directing torque source 254 to supply torque to actuator 154 to position service station 224 and cartridge 230 opposite to print heads 220 such that spitting area 306 may receive and absorb ink or fluid ejected from the nozzles of print heads 146. Because spitting area 306 has a length equal to or greater than the length of print heads 146, each of the nozzles of print heads 146 may be primed at one time. Because spitting area 306 is located immediately adjacent to support 284, any fluid remaining on the faces of print heads 146 after blow priming or spitting may be immediately wiped to inhibit the fluid or ink from being pulled back into print heads 220 by capillary action which would otherwise result in the mixing of different colors of ink or different fluids.

Support 284 comprises a structure configured to support the webbing of material 304 at an elevated position with respect to webbing 306. In other embodiments, support 284 may alternatively support 304 at a height similar to or less than that of spitting area 306. Support 284 resiliently supports webbing of material 304 during contact with print heads 146 during wiping. In the example illustrated, support 284 comprises a foam rubber roller 474 which includes a foam material about a rigid shaft that is resiliently supported by a resilient suspension 476. In one embodiment, suspension 476 comprises a preloaded shock or spring secured at one end of housing 276 or a structure fixedly secured to housing 276 and an opposite end secured to journal supports 478 which support foam roller 474. Suspension 476 allows the axis of roller 474 to conform to any macro misalignments between cartridge 30 and the face of print heads 146. As a result, material 304 may be placed into contact with print heads 146 while maintaining even pressure. In addition, spring loading of supports 478 compensates for larger misalignments between the faces of print heads 146 during wiping while maintaining even wipe pressure In other embodiments, support 284 may include other structures or materials for resiliently supporting material 304 or may omit such resilient supporting structures.

Input shaft 286 comprises a shaft configured to grip the material 304. In the embodiment illustrated, input shaft 286 comprises a knurled shaft rotatably supported by frame 276. As a result, cartridge 230 provides accurate control of the take-up and unwinding of material 304. In other words, input shaft 286 provides uniform advance per a given input shaft rotation. In the embodiment illustrated, axial ends of input shaft 286 provide outward projections which are received within detents 400 of latches 248 as shown in FIG. 12. The axial ends of input shaft 286 serve to both longitudinally secure or service cartridge 230 in service station 224 and to provide a pivot axis about which cartridge 230 may be pivoted between a non-wiping position and a wiping position. As a result, printing system 210 may use fewer parts and occupy less space.

Drive train 288 includes components associated with both service station 224 and cartridge 230. As shown by FIGS. 9, 13 and 14, drive train 88 additionally includes cluster gear 490, intermediate idler gears 492, input shaft gear 494 and friction clutch 310 associated with cartridge 230. Cluster gear 490 includes an outer most gear 500 (shown in FIG. 9) and an inner gear 314. As shown by FIG. 12, when cartridge 230 is inserted into station 224, gear 500 meshes with gear 456 of drive train 288. As shown by FIG. 13, gear 314 of cluster gear 490 meshes with intermediate gear 492 of gear 314 which is further secured to take-up core 280 to rotate take-up core 280 and to take up material 304. Gear 314 further cooperates with clutch mechanism 290 to inhibit payout of material 304 during wiping of print heads 146.

Idler gears 492 are rotatably supported by housing 276 and are in meshing engagement with one another so as to transmit torque to input shaft gear 494. Input shaft 494 is rotatably supported by housing 276 and is secured to input shaft 286. In the embodiment illustrated, gear 314 is overdriven relative to the rotation of gear 494. As a result, material 304 is more tightly wound about core 280 and is more securely held against input shaft 286. Clutch 310 comprises a friction clutch configured to facilitate relative rotation between gear 314 and take-up core 280.

One-way clutch mechanism 290 comprises a one-way clutching mechanism operably coupled between gear 112 and supply core 278. Like one-way clutch 90, one-way clutch 90 is configured to permit faster relative angular rotation of gear 112 with respect to the angular rotation of supply core 278 and to inhibit or prevent faster angular relative rotation of take-up core 278 with respect to data of gear 312. In other words, one-way clutch mechanism 290 allows for low back tension of supply core 278 while preventing excess material 304 from being pulled out when the wiping friction forces would otherwise do so. In the example illustrated, one-way clutch mechanism 290 includes gear 318, arm 320 and ratchet 322 which are substantially identical to gear 118, arm 120 and ratchet 122, respectively, described above with respect to one-way clutch mechanism 90. In example illustrated, arm 320 resiliently supports ratchet 322 in concurrent meshing engagement with gear 312 and gear 318, wherein arm 320 resiliently deflects during driving of gear 312 by torque source 54 to payout material 304.

In the particular example illustrated, one way clutch mechanism 290 additionally includes drag 323. Drag 323 comprises a resilient arm cantilevered from housing 276 into engagement with an outer diamer of gear 318. Drage 323 adds a drag force to inhibit rotation of gear 318 and payout of material 306 which may occur during ratcheting of gear 322. In other embodiments, drag 323 may alternatively by omitted.

Drop detect basin 292 is similar to drop detect basin 92 described above with respect to system 10. In particular, drop detection basin 92 comprises a receptacle or chamber configured to receive fluid or ink droplets ejected from nozzles of print heads 146. In the example illustrated, basin 292 spans multiple print heads such that the operation of the nozzles of each of print heads 146 may be simultaneously detected by sensors 294.

Sensors 294 extend opposite to basin 292 and detect the passing of droplets therethrough to basin 292. In the example illustrated, sensors 294 comprise optical sensors having an emitter which emist an optical beam towards an optical detector, wherein droplets passing between the emitter and the detector interrupt the beam which results in signals being transmitted to controller 32. Controller 32 uses the received signals from sensors 294 to determine which, if any, of nozzles of print heads 146 are clogged or are malfunctioning. Because basin 292 and sensors 294 are located on an opposite side of support 284 as spitting area 306, detection of nozzle malfunctioning may be performed without contamination of material 304 prior to use of material 304 to wipe print heads 146. Because waste fluid or ink from each of wiping, spitting or priming and drop detection is captured in the same removable cartridge 230, removal, recycling and replacement of such waste ink is facilitated.

Payout indicator 295 comprises a device configured to be sensed by payout sensor 257 associated with service station 224 so as to indicate the presence of cartridge 230 in station 224 and the payout of material 304. In the example illustrated, indicator 295 comprises an interrupter wheel rotatably supported by housing 276 and operably coupled to gear 318 so as to rotate in proportion to rotation of gear 318 and supply core 278. During rotation of supply core 78 during the payout of material 304, indicator 295 also rotates such that notches, windows or other openings in indicator 295 and intermediate blocking portions of indicator 295 alternately interrupt optical beams of sensor 257 to create pulses which are transmitted to controller 32 to enable controller 32 to sense rotation of indicator 295. In the example illustrated, indicator 295 is located at an insertion end 520 of cartridge 230 such that indicator 295 is sensed by sensor 257 upon full or substantially complete insertion of cartridge 30 into service station 24, wherein sensor 257 is able to detect the presence or absence of indicator 295. Because indicator 295 is operably coupled to supply core 278 and because indicator 295 is located at end 520 of cartridge 230, indicator 295 cooperates with sensor 257 to provide several benefits: (1) the indication of when cartridge 230 is fully inserted into service station 224 or is present, (2) the indication of whether material 304 is properly being advanced or whether the supply roll of material 304 is empty or jammed by the lack pulses or (3) the provision of signals which may be used by controller 32 to determine or estimate the expenditure of material 304 from supply core 278 or the remaining amount of material 304 about supply core 278. All of such benefits are provided by a single indicator-sensor mechanism.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A printer comprising:

a media support;

a first print head service shuttle; and a first print head support carrying a plurality of print heads, the first support being movable towards and away from the media support and including one or more guides movably supporting the first print head service shuttle along the media support.

2. The printer of claim 1, wherein the media support comprises a series of rollers configured to support media in an arc.

3. The printer of claim 2, wherein the rollers are configured to support a web of media.

4. The printer of claim 3 further comprising:

a second print head service shuttle;

a second print head support carrying a plurality of print heads, the second print head support being movable towards and away from the media support and including one or more guides movably supporting the second print head service shuttle along the media support;

an arcuate frame supporting the first print head support and the second print head support in an arc about the media support; and at least one actuator configured to move the arcuate frame so as to concurrently move the first print head support and the second print head support towards and away from the media support.

5. The printer of claim 1, wherein the media support is configured to support a web of media and wherein the printer further comprises:

a second print head service shuttle;

a second print head support carrying a plurality of print heads, the second print head support being movable towards and away from the media support and including one or more guides movably supporting the second print head service shuttle along the media support;

an arcuate frame supporting the first print head support and the second print head support in an arc about the media support; and at least one actuator configured to move the arcuate frame so as to concurrently move the first print head support and the second print head support towards and away from the media support.

6. The printer of claim 1, wherein the one or more guides comprise guide rails along which the first print head service shuttle moves.

7. The printer of claim 1, wherein the media support is configured to move media in a first direction and wherein the first print head service shuttle is movable and a second direction perpendicular to the first direction.

8. The printer of claim 7, wherein the plurality of print heads are arranged in one or more rows extending in the second direction.

9. The printer of claim 1, wherein the first print head service shuttle includes a web of absorbent material.

10. The printer of claim 1, further comprising a first print head service drive carried by the support and is configured to move the first print head service shuttle along the one or more guides.

11. The printer of claim 10, wherein the first print head service shuttle comprises:

a service cartridge configured to service the plurality of print heads; and a service station movable along the one or more guides and configured to removably receive the service cartridge.

12. The printer of claim 10, wherein the first print head service shuttle drive comprises:

a rack gear along the one or more guides; and a pinion gear carried by the first service station shuttle in engagement with a rack gear.

13. The printer of claim 1, wherein the media support is configured to support a print medium opposite to the plurality of print heads while the print medium is being printed upon by the plurality of print heads and wherein the printer further comprises one or more actuators configured to vertically translate the print head supports so as to raise and lower the first print head support towards and away from the media support.

14. The printer of claim 1, wherein the print head support is configured to support the plurality of print heads such that the plurality of print heads deposit printing material directly onto a print medium while the print medium is supported by the media support.

15. The printer of claim 1, wherein the print head service shuttle is movably supported by the one or more guides for movement between a servicing position, in which the print head service shuttle is sandwiched between the media support and at least one of the plurality of print heads, and a withdrawn position in which the print head service shuttle is withdrawn from between the media support and the at least one of the plurality of print heads.

16. A method comprising:

supporting first print heads opposite to a media with a first print head support;

raising the first print head support relative to the media; and moving a first print head service station shuttle along one or more guides of the support to a position opposite the print heads.

17. The method of claim 16 further comprising moving the media in an arc relative to the first support.

18. The method of claim 16 further comprising servicing the first print heads with the first service station shuttle by moving a first web carried by the first shuttle across the first print heads.

19. The method of claim 16 further comprising:

supporting second print heads opposite to a media with a second support;

raising the second support relative to the media; and moving a second print head servicing shuttle along one or more second guides of the second support to a position opposite the second print heads.

20. The method of claim 19, wherein the first print head servicing shuttle and the second print head servicing shuttle are raised in unison as the first print head support is raised and wherein the first print head servicing shuttle and the second print head servicing shuttle are moved out of unison along the one or more first guides and the one or more second guides, respectively.

21. The method of claim 16 further comprising removing a service cartridge from a service station of the first print head service shuttle.

22. A printer comprising:

means for supporting first print heads opposite to a media;

means for raising the first print head support relative to the media; and means for moving a first service station shuttle along one or more guides of the means for supporting to between a first position opposite the print heads and a second position not opposite the print heads.

* * * * *

UNITED STATES PATENT AND TRADEMARK OFFICE

CERTIFICATE OF CORRECTION

PATENT NO. : 8,038,258 B2
APPLICATION NO. : 12/251977
DATED : October 18, 2011
INVENTOR(S) : Paul C. Ray et al.

It is certified that error appears in the above-identified patent and that said Letters Patent is hereby corrected as shown below:

In column 17, line 47, in Claim 10, after "and" delete "is".

Signed and Sealed this
Thirty-first Day of July, 2012

David J. Kappos

David J. Kappos
*Director of the United States Patent and Trademark Office*